US005691057A

United States Patent [19]

Bennie et al.

[11] Patent Number: 5,691,057

[45] Date of Patent: Nov. 25, 1997

[54] POLYESTER MIXED YARNS WITH FINE FILAMENTS

[75] Inventors: David George Bennie, Rocky Point; Robert James Collins, Wilmington; Hans Rudolf Edward Frankfort, Kinston; Stephen Buckner Johnson, Wilmington, all of N.C.; Benjamin Hughes Knox, Wilmington, Del.; Joe Forrest London, Jr., Greenville, N.C.; Elmer Edwin Most, Jr., Durham, N.C.; Girish Anant Pai, Matthews, N.C.

[73] Assignee: E. I. Du Pont de Nemours and Company, Wilmington, Del.

[21] Appl. No.: 468,908

[22] Filed: Jun. 6, 1995

Related U.S. Application Data

[63] Continuation-in-part of Ser. No. 214,906, Mar. 16, 1994, abandoned, which is a continuation-in-part of Ser. No. 925,041, Aug. 5, 1992, abandoned, and Ser. No. 93,156, Jul. 23, 1993, Pat. No. 5,417,902, which is a continuation-in-part of Ser. No. 926,538, Aug. 5, 1992, abandoned, and Ser. No. 925,042, Aug. 5, 1992, abandoned, each is a continuation-in-part of Ser. No.647,381, Jan. 29, 1991, abandoned, and Ser. No. 860,776, Mar. 27, 1992, abandoned, which is a continuation-in-part of Ser. No. 647,371, Jan. 29, 1991, said Ser. No. 93,156, is a continuation-in-part of Ser. No. 15,733, Feb. 10, 1993, Pat. No. 5,250,245, Ser. No. 5,672, Jan. 19, 1993, Pat. No. 5,288,553, Ser. No. 753,769, Sep. 3, 1991, Pat. No. 5,261,472, and Ser. No. 786,582, Nov. 1, 1991, Pat. No. 5,244,616, which is a continuation-in-part of Ser. No. 338,251, Apr. 14, 1989, Pat. No. 5,066,447, which is a continuation-in-part of Ser. No. 53,309, May 22, 1987, abandoned, which is a continuation-in-part of Ser. No. 824,363, Jan. 30, 1986, abandoned, said Ser. No. 753,769, is a continuation-in-part of Ser. No. 338,251.

[51] Int. Cl.[6] ..... D02G 3/00

[52] U.S. Cl. ..... 428/373; 428/365; 428/364; 428/374; 57/243; 57/244

[58] Field of Search ..... 428/374, 364, 428/373, 365; 57/243, 244, 247, 248, 6, 227, 228, 350

[56] References Cited

U.S. PATENT DOCUMENTS

| | | | |
|---|---|---|---|
| 2,980,492 | 4/1961 | Jamieson et al. | 18/54 |
| 3,771,307 | 11/1973 | Petrille | 57/157 |
| 3,998,042 | 12/1976 | Reese | 57/140 |
| 4,592,119 | 6/1986 | Bauer et al. | 28/271 |
| 5,145,623 | 9/1992 | Hendrix et al. | 264/103 |
| 5,223,198 | 6/1993 | Frankfort | 264/103 |
| 5,244,616 | 9/1993 | Hendrix et al. | 264/103 |
| 5,308,564 | 5/1994 | Grundstaff | 264/103 |
| 5,364,701 | 11/1994 | Boles et al. | 428/373 |

OTHER PUBLICATIONS

McGraw Hill Dictionary of Chemical Terms, Parker, ed, 1985, p. 339.

Moncrieff, Man—Made Fibers, Wiley & Sone, 1975, p. 728.

Encyclopedia of Polymer Science and Engineering, vol. 10., p. 374, 1989, Wiley & Sons.

*Primary Examiner*—Merrick Dixon

[57] ABSTRACT

Polyester mixed fine filament yarns having excellent mechanical quality and uniformity, and preferably with a balance of good dyeability and shrinkage, are prepared by a simplified direct spin-orientation process by selection of polymer and spinning conditions.

10 Claims, 7 Drawing Sheets

COLD CRYSTALLIZATION TEMPERATURE (Tcc),°C
150
140
130
120
110
100
90
80
a
b
c
d
0
.02
.04
.06
.08
AMORPHOUS BIREFRINGENCE (△α)

POST YIELD SECANT MODULUS (Tan β),g/d
12
10
8
6
4
2
0
Tan β < Tan α
Tan β = Tan α
0
.020
.040
.060
.080
.100
.120
.140
BIREFRINGENCE (△n)

POLYESTER MIXED YARNS WITH FINE FILAMENTS

CROSS-REFERENCE TO RELATED APPLICATION

This application is a continuation-in-part of our application Ser. No. 08/214,906, filed Mar. 16, 1994, which is being abandoned in favor of the present application and is itself a continuation-in-part of our applications Ser. Nos. 07/925,041, filed Aug. 5, 1992, and now abandoned, and 08/093,156, filed Jul. 23, 1993, now U.S. Pat. No. 5,417,902, itself a continuation-in-part of abandoned application Ser. No. 07/926,538, filed Aug. 5, 1992, and also of abandoned application Ser. No. 07/925,042, by Aneja et al., also filed Aug. 5, 1992, all themselves continuations-in-part of abandoned applications Ser. Nos. 07/647,381, filed by Collins et al., Jan. 29, 1991, and 07/860,776, filed by Collins et al., Mar. 27, 1992, as a continuation-in-part of abandoned application Ser. No. 07/647,371, sometimes referred to as our "parent application", also filed Jan. 29, 1991, application Ser. No. 08/093,156 being also a continuation-in-part of applications Ser. No. 08/015,733, filed Feb. 10, 1993, now U.S. Pat. No. 5,250,245, Ser. No. 08/005,672, filed Jan. 19, 1993, now U.S. Pat. No. 5,288,553, Ser. No. 07/753,769, filed by Knox et al., Sep. 3, 1991, and now U.S. Pat. No. 5,261,472, Ser. No. 07/786,582, filed by Hendrix et al., Nov. 1, 1991, now U.S. Pat. No. 5,244,616, both filed as continuations-in-part of application Ser. No. 07/338,251, filed Apr. 14, 1989, now U.S. Pat. No. 5,066,447, itself a continuation-in-part of abandoned application Ser. 07/053,309, filed May 22, 1987, itself a continuation-in-part of abandoned application Ser. No. 06/824,363, filed Jan. 30, 1986.

TECHNICAL FIELD

This invention concerns improvements in and relating to polyester (continuous) mixed-filament yarns of differing filament denier and/or cross-section, including fine filaments, and preferably to such yarns with a capability of providing from the same feed stock polyester mixed-filament yarns of various differing properties; including improved processes and new products therefrom.

BACKGROUND

Historically, synthetic fibers for use in apparel, including polyester fibers, have generally been supplied to the textile industry for use in fabrics and garments with the object of more or less duplicating and/or improving on natural fibers. For many years, commercial synthetic textile filaments, such as were made and used for apparel, were mostly of deniers per filament (dpf) in a similar range to those of the commoner natural fibers; i.e., cotton and wool. More recently, however, polyester filaments have been available commercially in a range of dpf similar to that of natural silk, i.e. of the order of 1 dpf, and even in sub deniers, i.e., less than about 1 dpf, despite the increased cost. Various reasons have been given for the recent commercial interest in such lower dpfs, such as about 1 dpf, or even sub deniers.

Our so-called "parent application" (originally Ser. No. 07/647,371, but now abandoned in favor of continuation-in-parts, and issued as U.S. Pat. No. 5,250,245) the disclosure of which is hereby incorporated herein by reference, was concerned with the preparation of fine filaments (of dpf 1 or less, preferably 0.2 to 1, and especially of dpf 0.2 to 0.8), by a novel direct melt spinning/winding process, in contrast with prior processes of first spinning larger filaments which then needed to be further processed, in a coupled or a separate (split) process involving drawing, to obtain the desired filaments of reduced denier with properties suitable for use in textiles. Such fine filaments of the "parent application" are "spin-oriented"; that is, produced as "undrawn" filaments. The significance of this is discussed in the art and hereinafter.

We have found that consumer reaction to fine filament textile (flat or textured) yarns in which all the filaments are of essentially the same cross-section and of essentially the same denier, and especially wherein all the filaments are of denier less than about 1, has tended to limit their use to selected textile fabrics where fabric "body" and "drape" has not been important or where providing such fabric "body" and "drape" through twisting of the multi-filament yarns and/or change in fabric construction is too expensive for the particular end-use and/or where such changes adversely affect other properties (such as visual and tactile aesthetics) that make such fabrics undesirable. It would be desirable to make fine textile fabrics with desired "body" and "drape" from fine filament yarns without twisting of the free filament yarns and/or change in fabric construction. It would also be desirable to provide spin-oriented undrawn fine filament yarns that, depending on their combination of properties, can be used as direct-use yarns or as draw feed yarns (e.g., to provide drawn flat yarns or textured "bulky" yarns) that can provide fabric "body" and "drape" without having to incur costly yarn twisting, for example, and without having to change fabric construction and compromise visual and tactile fabric aesthetics.

It is important to maintain uniformity, both along-end and between the various spin-oriented filaments and drawn filaments therefrom. Lack of uniformity often shows up in the eventual dyed fabrics as dyeing defects, so is undesirable.

For textile purposes, a "textile yarn" must have certain properties, such as sufficiently high modulus and yield point, and sufficiently low shrinkage, which have distinguished conventional textile yarns from conventional "feed yarns" that have required further processing to provide the minimum properties required for making textiles and subsequent use. Generally, herein, we refer to untextured filament yarns as "flat yarns" and to undrawn flat filament yarns by terms such as "feed" or "draw-feed" yarns. Filament yarns which can be used as a textile yarn without need for further drawing and/or heat treatment are referred herein as "direct-use yarns".

It is important to recognize that what is important for any particular end-use is the combination of all the properties of the specific yarn (or filament), sometimes in the yarn itself during processing, but also in the eventual fabric or garment of which it is a component. It is easy, for instance, to modify the shrinkage by a processing treatment, but such processing modification is generally accompanied by other changes, so it is the combination or balance of properties of any filament (or staple fiber) that is important. It should also be understood that the filaments may be supplied and/or processed according to the invention in the form of a yarn or as a bundle of filaments that does not necessarily have the coherency of a true "yarn", but for convenience herein a plurality of filaments may often be referred to as a "yarn" or "bundle", without intending specific limitation by such term. It will be recognized that, where appropriate, the technology may apply also to polyester filaments in other forms, such as tows, which may then be converted into staple fiber, and used as such in accordance with the balance of properties that is desirable and may be achieved as taught hereinafter.

SUMMARY OF THE INVENTION

As indicated hereinbefore, improvements have been obtained according to the invention by providing a novel process for spinning mixed-filament yarns, and the resulting mixed-filament yarns themselves.

The polyester polymer used for preparing spin-oriented undrawn fine mixed-filament yarns of the invention may be the same as for the "parent application".

The spin-orientation process for preparing polyester undrawn fine mixed-denier yarns comprised of two or more types of filaments that differ, by cross-section and/or denier, wherein at least one of the filament components is a fine filament type that has denier less than about 1, preferably wherein the average yarn filament denier when drawn to 30% elongation is less than about 1, and especially wherein the average yarn filament denier of the fine mixed-filament yarn is less than about 1, is essentially the same process as the "spin-orientation" process of the "parent application" (and described herein in the discussion of FIGS. 4A, B, and C), except for the selection of spinneret capillaries of different configurations, such as capillary dimensions (L and D) and exit orifice shape, to co-spin two or more different filament components; and spinning hardware configuration modifications, if needed, to quench and converge the different filament components into a mixed-filament bundle prior to interlacing and winding into packages. It will be understood that either or both of the cross-section and of the denier (of resulting filaments) may differ (significantly) to provide the advantages mentioned herein, as will be seen in the Examples.

It was very surprising to us that such mixtures of deniers and, if desired, cross-sections could be cospun from a single spinneret with uniformity, as desired, in view of previous attempts to cospin mixtures of polyester filaments at higher dpfs, and to cospin mixtures of polyester filaments at prior art low speeds to provide undrawn filaments of low orientation. There is something unique about the process technique of the parent application that makes possible such a surprising result.

As will be understood, particularly useful mixed-filament draw feed yarns have two types of filaments, one of which is a fine filament and has a drawn dpf (and preferably a spun dpf) less than about 1, the spun dpf being referred to as "$(dpf)_1$", while the dpf of the other (fatter type) is not only greater than 1, as regards the draw feed yarn but also such that the resulting dpf is greater than 1 even after drawing to the desired extent, such as to the desired residual draw ratio (RDR). As indicated, it was surprising that such mixed dpf filaments could be cospun (and drawn, if desired) to provide uniform filaments. It is the dpf of the low dpf (free) filament (type) that will likely be of major interest and concern, together with the average dpf of the entire yarn (i.e., including filaments of conventional dpf, i.e., higher dpf filament type(s) also). The low dpf (fine) filament (type) will generally be as described in the "parent application", and of dpf about 1 or less, especially about 0.2 to 1 dpf, and most desirably generally 0.2 to 0.8 dpf. Higher dpf (fatter) filaments may be of dpf up to about 6, 7 or 8, as desired, for example, and usually up to about 3.5; this will generally depend on aesthetics (visual and/or tactile) and whether the yarn is intended to be drawn, as drawing will reduce the denier of the filaments that will be contained in any fabric.

It is generally desirable that the RDRs of both types of drawn filaments be in the approximate range 1.2× to 1.4×. It is also desirable that the draw feed yarns be drawable without incurring broken filaments or "neck-drawn" defects. It is desirable, accordingly, for the RDRs of both types of filaments to differ by less than about 40%, so that the RDRs of the types of the drawn filaments differ by about 20% or less. Providing a higher dpf filament of odd (non-round) cross-section can be a very effective technique for achieving the desired objective(s).

Mixed-filament yarns of differing dpfs (one type more than 1 and the other less than one) of different cross-sections and that are "flat" are expected to be desirable for tactile and aesthetic reasons. Similar mixed-filament yarns that are direct-use yarns in which all filaments are of low shrinkage are also expected to be useful. In this regard, non-round cross-sections for the higher dpf filaments are expected to provide a useful way to obtain the desired objective.

The yarns prepared by the process of the invention may be used as: 1) draw feed yarns (such as drawing in split or coupled processes, warp-draw processes, draw air-jet texturing, draw false-twist texturing, draw gear-crimping and draw stuffer-box crimping); 2) undrawn fine mixed-filament yarns capable of being used as direct-use "textile" mixed-filament yarns without need for further drawing and/or heating; 3) undrawn direct-use "textile" yarns that may be used as feed yarns without drawing as in air-jet texturing, stuffer-box and gear-crimping to provide bulky textile filament yarns; 4) undrawn direct-use "textile" fine mixed-filament yarns that are capable of being partially or fully drawn with or without heat and with or without post heat-treatment to uniform fine mixed-filament yarns.

The spin-orientation process of the process, described herein before, provides a spin-oriented polyester undrawn fine mixed-filament yarn, wherein the polyester polymer is characterized by a relative viscosity (LRV) in the range of about 13 to about 23, a zero-shear melting point ($T_M^o$) in the range of about 240° C. to about 265° C., and a glass-transition temperature ($T_g$) in the range of about 40° C. to about 80° C.; and wherein the mixed-filament yarn, comprised of two or more filament components that differ in cross-section and/or denier such that at least one filament component has a filament denier less than about 1 (preferably having an average yarn filament denier $(dpf)_s$ such that the average drawn yarn filament denier $(dpf)_D$ is less than about 1, where $(dpf)_D$ is defined by $\{(dpf)_s \times [(1.3)/(1+Eb/100)_s]\}$; and especially where the undrawn yarn average filament denier $(dpf)_s$ is less than about 1) such that for mixed-denier yarns the filament denier ratio of the high denier (fatter) filaments (2) to the low denier (fine) filaments (1) is about 2:1 to about 6:1; larger filament denier ratios up to about 8:1 may also prove useful; and further characterized by: a maximum dry heat shrinkage tension $ST_{max}$ less than about 0.2 g/d at a dry heat peak shrinkage tension temperature $T(ST_{max})$ about 5° C. to about 30° C. greater than about the polymer glass-transition temperature Tg; a $(1-S/S_m)$ value at least about 0.1 (and preferably at least about 0.25) to provide age stability shrinkage; an elongation-to-break ($E_B$) about 40% to about 160% (preferably about 90% to about 120% for draw feed yarns, and especially about 40% to about 90% with a $(1-S/S_m)$ value of at least about 0.85 for use as an undrawn direct-use yarn); a tenacity-at-7% elongation ($T_7$) in the range of about 0.5 and about 1.75 g/d (preferably in the range of about 0.5 to about 1 g/d (and especially such that the tenacity-at-7% elongation $T_7$ is less than the tenacity-at-20% elongation $T_{20}$ for improved draw stability) for a draw feed yarn and especially in the range of about 1 to about 1.75 g/d for use as a direct-use yarn); and a break tenacity $(T_B)_n$, normalized to 20.8 polymer LRV, desirably at least about 5 g/d (preferably at least about 6 g/d); and preferably having a thermal stability ($S_2$) indicated by a difference between the Dry Heat Shrinkage (DHS, measured at 180° C.) and the Boil-Off Shrinkage (S), i.e. a value (DHS−S) of less than +2%.

The undrawn mixed filament yarns of the invention provide for drawn flat or air-jet textured mixed-filament yarns having a filament Shrinkage Differential, i.e., a difference in filament shrinkages (S), of at least 5%, prepared by drawing the undrawn mixed-filament yarns at a temperature in a range from about the polymer glass-transition temperature ($T_g$) up to about the onset temperature of major crystallization ($T_c^o$), said drawn yarns being further characterized by a residual elongation-to-break ($E_B$) about 15% to about 45%, and a tenacity-at-7% elongation ($T_7$) at least about 1 g/d; and especially drawn mixed-filament flat and air-jet textured yarns having a Shrinkage Differential of at least 5% prepared by cold drawing without post heat setting the undrawn direct-use mixed-filament yarns, described herein above, and wherein the cold drawn differential mixed-filament yarns are further characterized by a residual elongation-to-break ($E_B$) about 15% to about 55%, and a tenacity-at-7% elongation ($T_7$) at least about 1 g/d. It is at least a minimum Shrinkage Differential (difference between boil-off shrinkages) that is needed to provide a mixed shrinkage yarn that will bulk on heating (and shrinking). Yarns of Shrinkage Differentials of as much as 30% have been processed satisfactorily, and yarns with filaments having Shrinkage Differentials of about 50% have also been made and are expected to prove useful.

The invention provides uniform drawn polyester flat and textured fine mixed-filament yarns, prepared from the undrawn free mixed-filament feed yarns of the invention as described herein before, of an elongation-to-break ($E_B$) about 15 to about 45%, a ($1-S/S_m$) value at least about 0.85, a tenacity-at-7% elongation ($T_7$) at least about 1 g/d, preferably a post-yield modulus ($M_{py}$) about 5 to about 25 g/d; and preferably wherein the drawn flat fine-mixed filament yarns are further characterized by an along-end uniformity as measured by an along-end denier spread (DS) of less than about 3% (especially less than about 2%).

Further aspects and embodiments of the invention will appear hereinafter.

DETAILED DESCRIPTION OF THE INVENTION

The undrawn fine mixed-filament yarns of the invention are formed, essentially, according to the process of the "parent application" except for modifications to permit two or more different type filaments to be co-spun, quenched, and converged into a fine mixed-filament bundle. For example, mixed-denier filament yarns may be provided by combining filament bundles of different filament deniers and or cross-sections spun from the same or from different spin packs prior to interlacing and winding, but preferably prior to convergence and finish application. Advantageously, if desired, yarns may be prepared according to the invention from undrawn feed yarns that have been treated with caustic in the spin finish (as taught by Grindstaff and Reese in U.S. Pat. No. 5,069,844) to enhance their hydrophilicity and provide improved moisture-wicking and comfort.

Figure 3A:
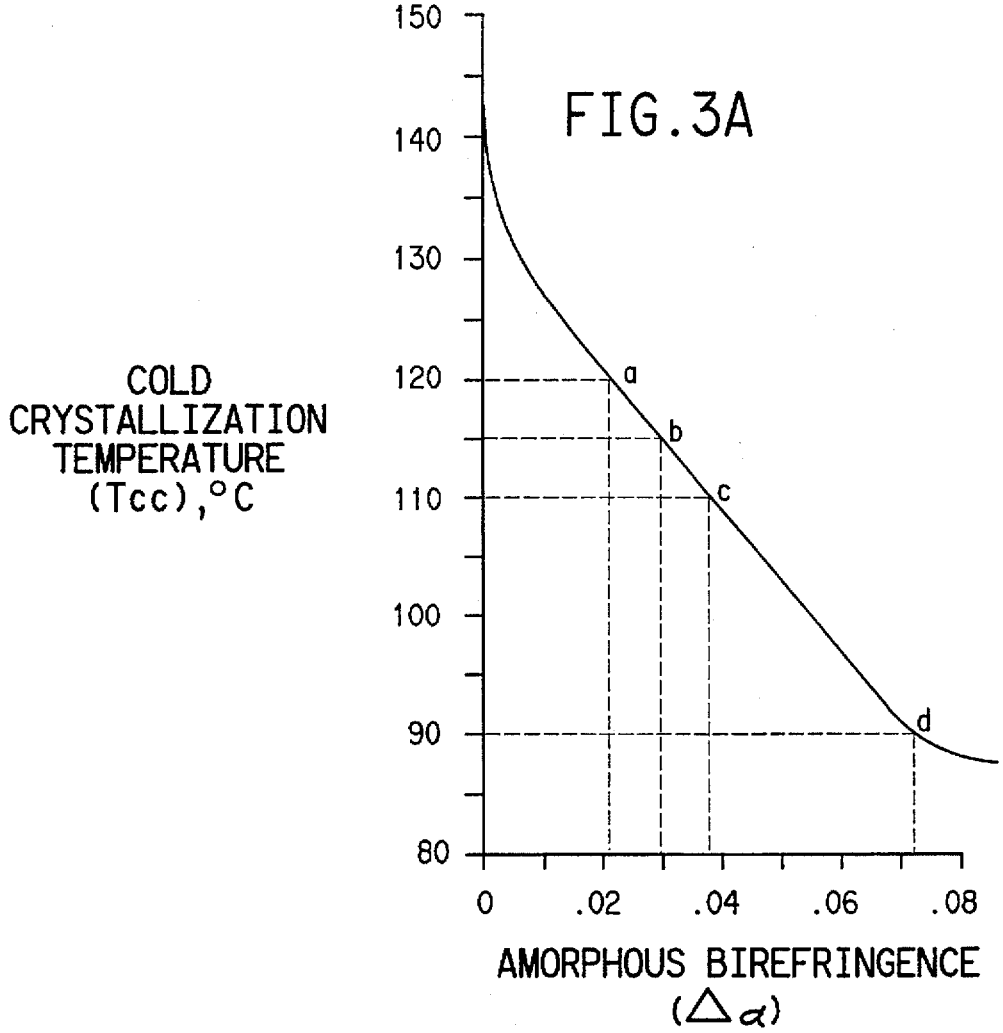
FIG. 3A is a representative plot of $T_{cc}$ (the peak temperature of "cold crystallization" ($T_{cc}$), as measured by Differential Scanning Calorimetry (DSC) at a heating rate of 20° C. per minute), versus amorphous birefringence, a measure of amorphous orientation (as expressed by Frankfort and Knox). For filaments for which measurement of birefringence is difficult, the value of $T_{cc}$ is a useful measure of the amorphous orientation. The filaments of the invention have $T_{cc}$ values between about 90° C. and 110° C.
Figure 3B:
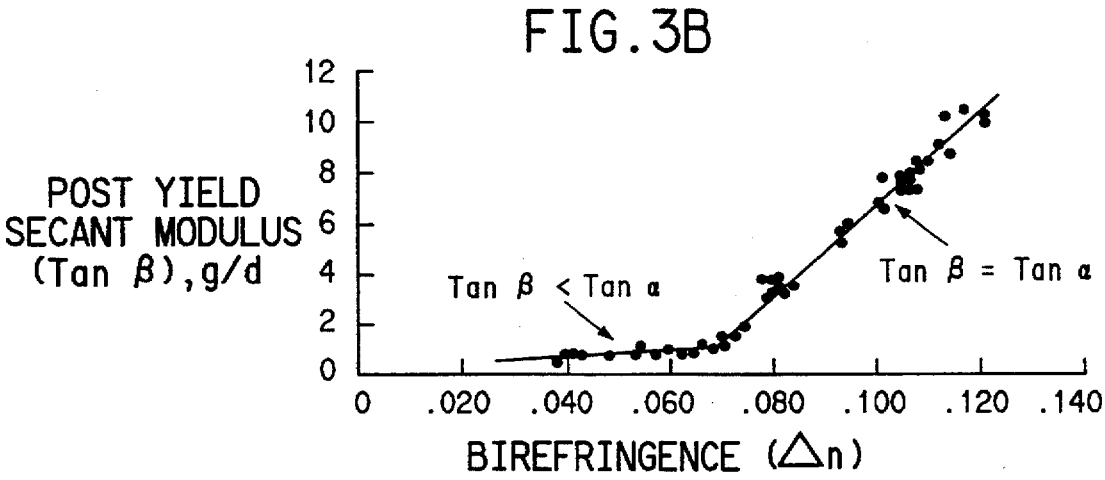
FIG. 3B is a representative plot of the post-yield secant modulus (Tan beta) (i.e., "$M_{py}$") versus birefringence. The $M_{py}$ herein is calculated from the expression $(1.20\ T_{20}-1.07\ T_7)/0.13$, where $T_{20}$ is the tenacity at 20% elongation, $T_7$ being the tenacity at 7% elongation. As may be seen, above about 2 g/d, the post-yield modulus ($M_{py}$) provides a useful measure of birefringence of spin-oriented, drawn, and textured filaments. Preferred drawn filaments of the invention have $M_{py}$ values of about 5 to 25 g/d.
Figure 4A:
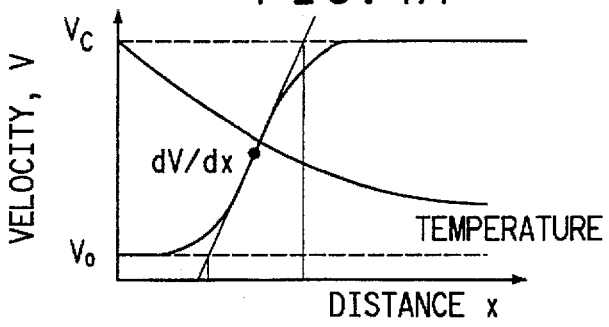
FIG. 4A is a graphical representation of spinline velocity (V) plotted versus distance (x) from the face of the spinneret, where the spin speed increases from the velocity at extrusion ($V_o$) to the final (withdrawal) velocity after having completed attenuation (typically measured downstream at the point of convergence, $V_c$); wherein, the apparent internal spinline stress is taken as being proportional to the product of the spinline viscosity at the neck point (i.e., herein found to be approximately proportional to about the ratio LRV $(T_m^o/T_p)^6$, where the temperatures are in Degrees C.),and the velocity gradient at the neck point (dV/dx) (herein found to be approximately proportional to about $V^2$/dpf, especially over the spin speed range of about 2 to 4 km/min, and proportional to about $V^{3/2}$/dpf at higher spin speeds, e.g., in the range of about 4 to 6 km/min). The spin line temperature is also plotted versus spinline distance (x) and is observed to decrease uniformly with distance as compared to the sharp rise in spinline velocity at the neck point. Process conditions are selected to provide during attenuation the development of an apparent internal spinline stress in the range of about 0.045 to about 0.105 g/d for preparing spin-oriented filaments, especially suitable for draw feed yarns (DFY), characterized with tenacity-at-7%-elongation ($T_7$) values in the range of about 0.5 to about 1 g/d, and an apparent internal spinline stress in the range of about 0.105 to about 0.195 g/d for preparing spin-oriented filaments especially suitable for direct-use yarns (DUY), characterized by tenacity-at-7%-elongation ($T_7$) in the range of about 1 to about 1.75 g/d; wherein, the apparent internal spinline stress is expressed herein by an empirical analytical expression: $k(LRV/LRV_{20.8})(T_R/T_P)^6(V^2/dpf)(A_o/\#_c)^{0.7}$, wherein k has an approximate value of (0.01/SOC) for spin-oriented filaments of density in the range of about 1.345 to about 1.385 g/cm$^3$, that is about 1.36 g/cm$^3$ and SOC is the "stress-optical coefficient" for the polyester polymer (e.g., about 0.7 in reciprocal g/d for 2GT homopolymer); $T_R$ is the polymer reference temperature defined by ($T_M^o$+40° C.) where $T_M^o$ is the zero-shear (DSC) polymer melting point; $T_P$ is the polymer melt spin temperature, °C.; V is the withdrawal speed expressed in km/min; $\#_c$ is the number of filaments (i.e., capillaries) for a given extrusion surface, $A_o$, expressed as $\#_c/cm^2$; LRV is the measured polymer (lab) viscosity and $LRV_{20.8}$ is the corresponding reference LRV-value (where LRV is defined herein after) of the polyester polymer having the same zero-shear "Newtonian" melt viscosity at 295° C. as that of 2GT homopolymer having an LRV-value of 20.8 (e.g., cationic-dyeable polyester of 15 LRV is found to have a melt viscosity as indicated by capillary pressure drop in the range of 2GT homopolymer of about 20 LRV and thereby a preferred reference LRV for such modified polymers is about 15.5 and is determined experimentally from standard capillary pressure drop measurements).
Figure 4B:
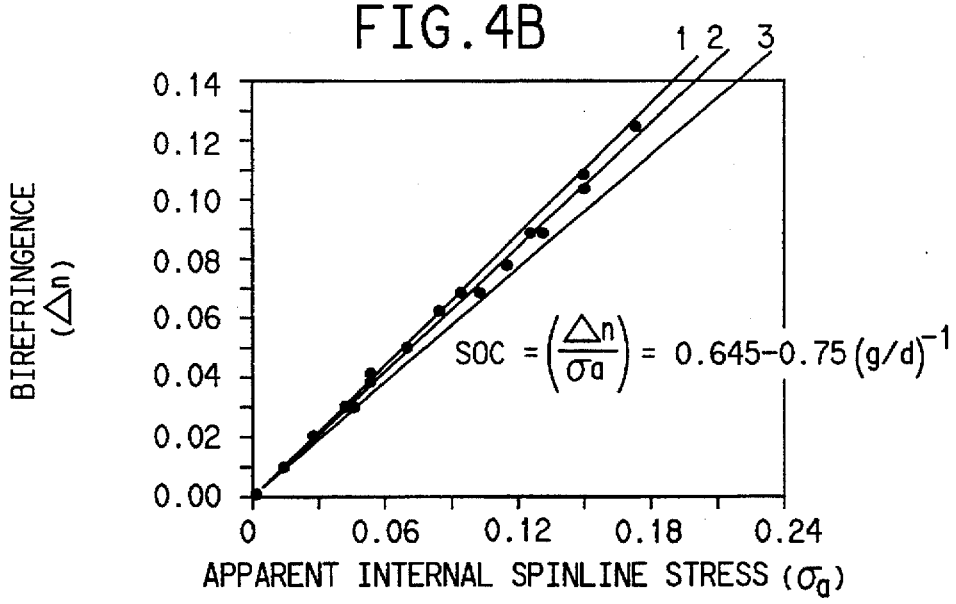
FIG. 4B is a graphical representation of the birefringence of the spin-oriented filaments versus the apparent internal spinline stress, the slope of which is referred to as the "stress-optical coefficient, (SOC), Lines 1, 2, and 3 have SOC values of 0.75, 0.71, and 0.645 $(g/d)^{-1}$, respectively, and are typical relationships found in literature for 2GT polyester. Thus, an average SOC is about 0.7.
Figure 4C:
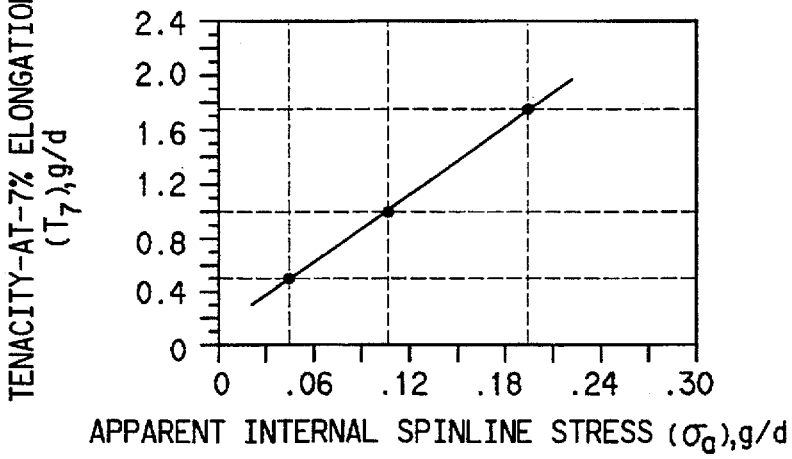
FIG. 4C is a graphical representation of the tenacity-at-7%-elongation ($T_7$) of the spin-oriented filaments versus the apparent internal spinline stress. The near linear relationships of birefringence and $T_7$ (each versus the apparent internal spinline stress) permits the use of $T_7$ as a practical measure of the filament average molecular orientation. Birefringence is a very difficult structural parameter to measure for fine filaments with deniers less than 1 and especially of odd-cross-section (including hollow filaments).
Figure 5:
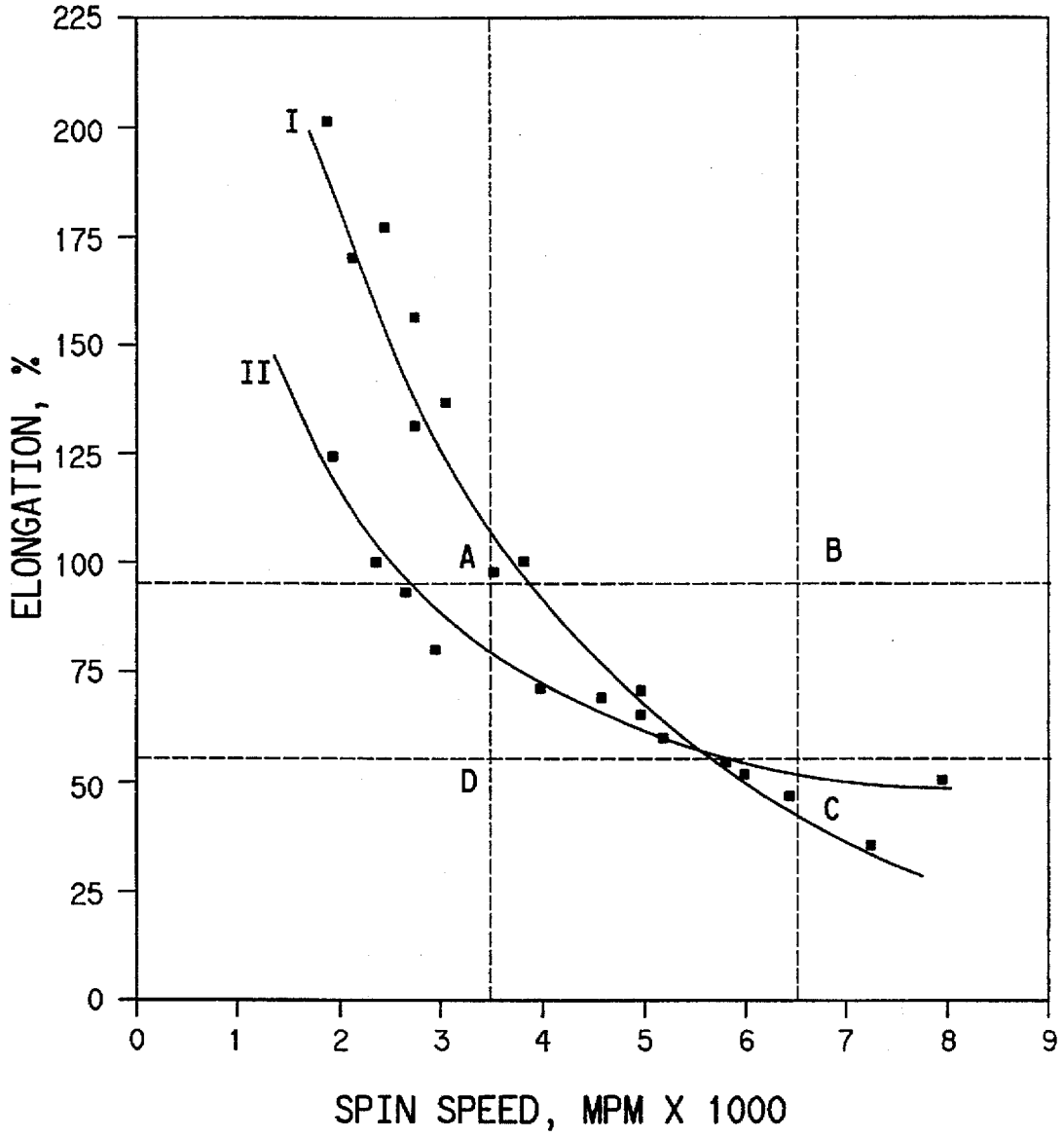
FIG. 5 is a representative plot of the elongations-to-break ($E_B$) of spin-oriented undrawn nylon (I) and polyester (II) versus spinning speed. Between about 3.5 Km/min and 6.5 Km/min (denoted by region ABCD) and especially between about 4 and 6 Km/min, the elongations of undrawn polyester and nylon filaments are of the same order. The elongation of the undrawn nylon filaments may be increased by increasing polymer RV (Chamberlin U.S. Pat. Nos. 4,583,357 and 4,646,514), by use of chain branching agents (Nunning U.S. Pat. No. 4,721,650), or by use of selected copolyamides and higher RV (Knox EP A1 0411774). The elongation of the undrawn polyester may be increased by lower intrinsic viscosity and use of copolyesters (Knox U.S. Pat. No. 4,156,071 and Frankfort and Knox U.S. Pat. Nos. 4,134,882 and 4,195,051), and by incorporating minor amounts of chain branching agents (MacLean U.S. Pat. No. 4,092,229, Knox U.S. Pat. No. 4,156,051 and Reese U.S. Pat. Nos. 4,883,032, 4,996,740, and 5,034,174). The elongation of polyester filaments is especially responsive to changes in filament denier and shape, with elongation decreasing with increasing filament surface-to-volume (i.e., with either or both decreasing filament denier and non-round shapes).
Figure 6:
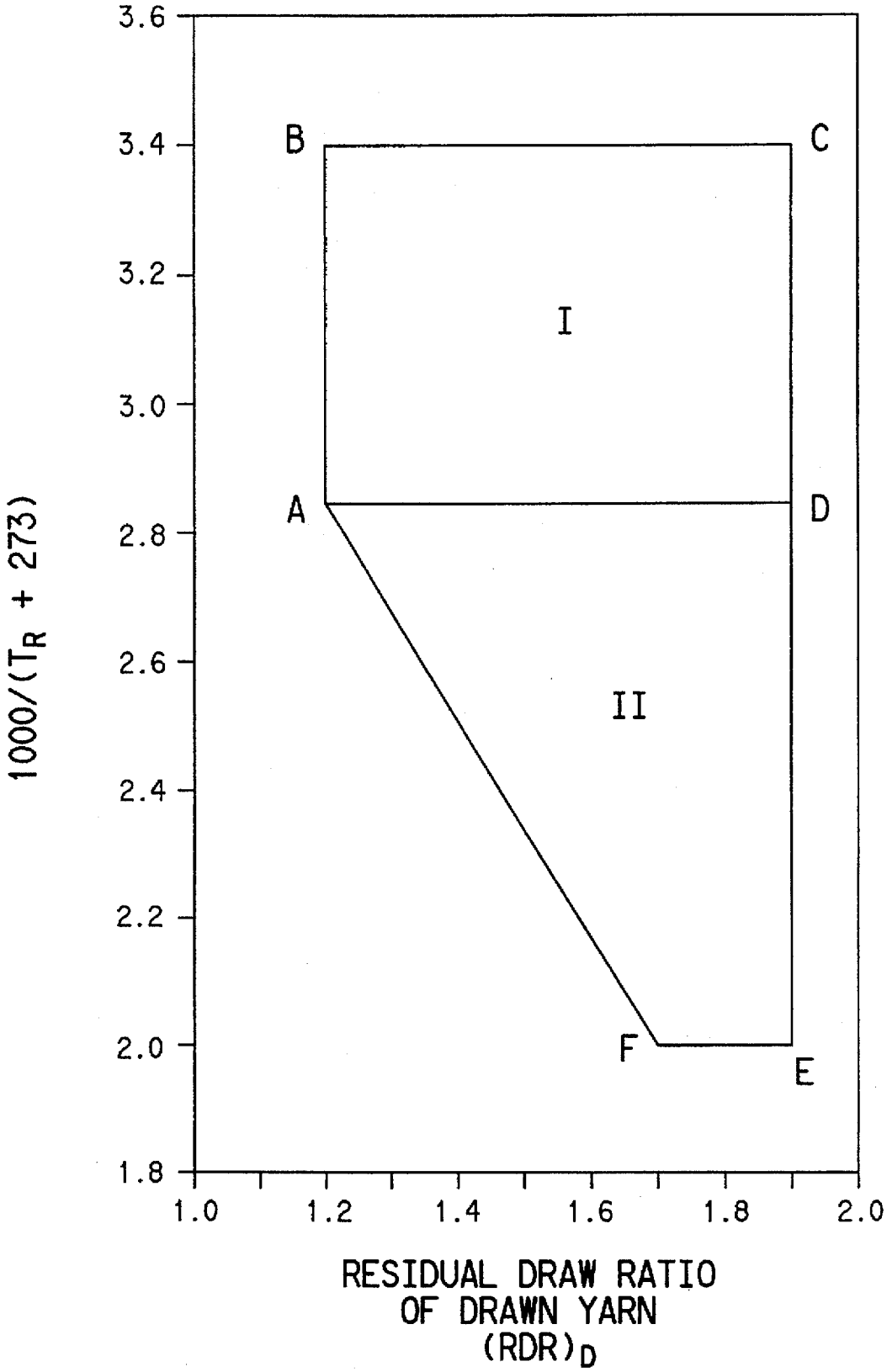
FIG. 6 shows the relationship between the relaxation/heat setting temperature $T_R$, (in degrees C.) and the residual draw ratio of the drawn yarns $(RDR)_D$ for nylon 66 graphically by a plot of $[1000/(T_R,+273)]$ vs. $(RDR)_D$ as described by Boles et al in U.S. Pat. No. 5,219,503. Drawn filaments, suitable for critically dyed end-uses are obtained by selecting conditions met by the regions I (ABCD) and II (ADEF). Acceptable along-end dye uniformity is achieved if the extent of drawing and heat setting are balanced as described by the relationship: $1000/(T_R, +273)>/=[4.95-1.75(RDR)_D]$. This relaxation temperature vs. $(RDR_D$ relation is also applied when co-drawing and heat-relaxing mixed-filament yarns, or heat-relaxing previously drawn and co-mingled mixed-filament yarns, such as co-drawn mixed-filament yarns, such as nylon/polyester filament yarns.

The degree of stress-induced (amorphous) orientation (SIO) imparted to these undrawn filaments during melt attenuation lowers the peak temperature of cold crystallization ($T_{cc}$), where the $T_{cc}$ is typically about 135° C. for amorphous unoriented filaments and which is decreased to less than 100° C. with increased stress-induced orientation (SIO) of the non crystalline (amorphous) polymer chains. This is graphically illustrated in FIG. 3A by a plot of the peak temperature of cold crystallization $T_{cc}$ versus amorphous birefringence [as defined by Frankfort and Knox]. The amorphous birefringence is known to increase with increasing spinning speed, and thereby with decreasing elongation-to-break ($E_B$) of the undrawn filaments. For the preferred undrawn spin-oriented filaments with elongations ($E_B$) in the range of 40 to about 120%, the measured $T_{cc}$-values are in the range of about 90° C. to about 110° C. which is believed to permit the onset of further crystallization even under mild drawing conditions and is believed, in part, to be important in providing uniform drawn polyester fine mixed-filament yarns even when drawn cold.

Figure 1A:
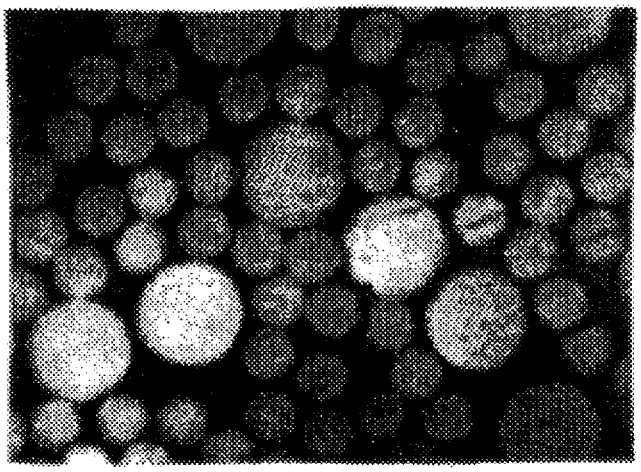
FIG. 1A is a magnified photograph of the filament cross-sections of an as-spun mixed dpf filament yarn of the invention, the fine filaments having a (spun) denier of less than 1, and the average dpf of the yarn would be less than 1 for such yarns when drawn to a nominal elongation of 30%.
Figure 1B:
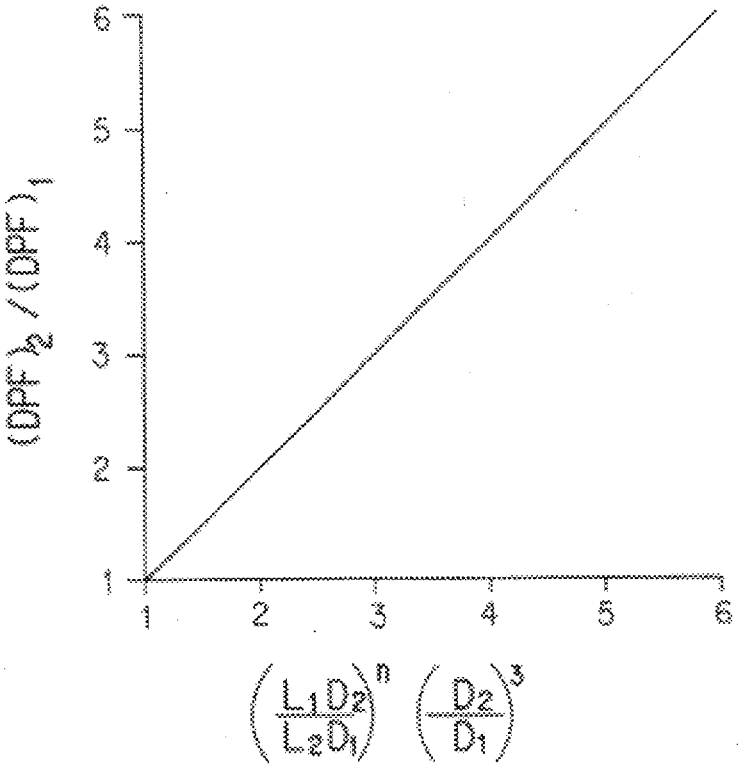
FIG. 1B plots the ratio $(dpf)_2/(dpf)_1$ for co-spun round filaments 1 and 2 vs $(L_1D_2/L_2D_1)^n(D_2/D_1)^3$, which is a simplified expression of $[(L/D)^n/D^3]_1/[(L/D)^n/D^3]_2$ for spinneret capillaries (1) and (2) of length (L) and diameter (D), (the value of "n" is 1 for Newtonian fluids; for the range of polymer LRV and process conditions used herein, the value of "n" is experimentally found to be about 1.1, in other words, n=1 is a useful practical approximation herein).
Figure 2A:
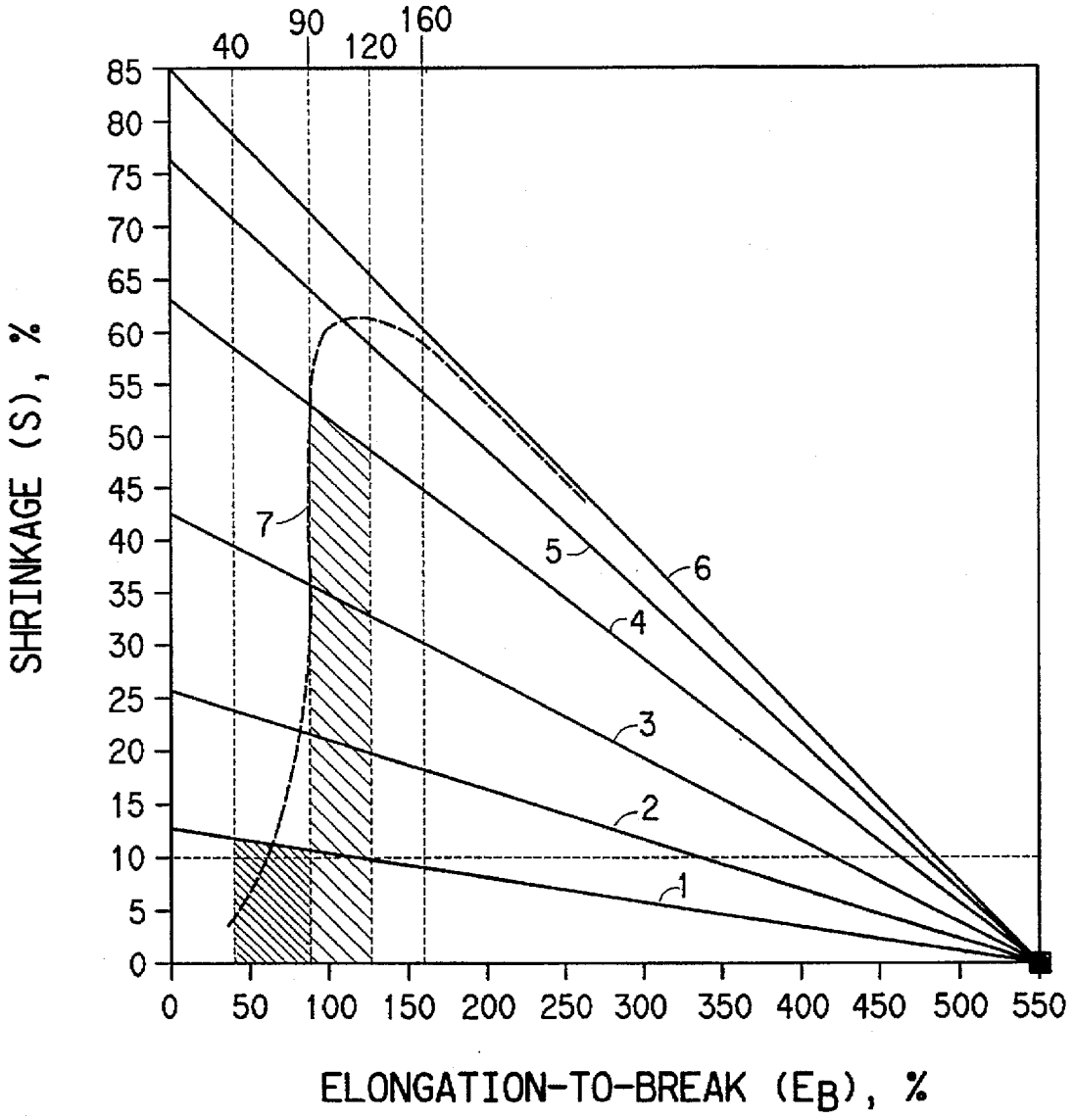
FIG. 2A is a representative plot of boil-off shrinkage (S) versus elongation-to-break ($E_B$) wherein Lines 1, 2, 3, 4, 5, and 6 represent ($1-S/S_m$)-values of 0.85, 0.7, 0.5, 0.25, 0.1 and 0, respectively; and curved line 7 represents a typical shrinkage versus elongation-to-break relationship for a series of yarns formed, for example, by increasing spinning speed, but keeping all other process variable unchanged. Changing other process variables (such as dpf or polymer viscosity) produces a "family" of similar curves, essentially parallel to each other. The vertical dashed lines denote ranges of approximate $E_B$-values for preferred filaments of the invention, i.e., 40% to 90% for direct-use, and 90% to 120% for draw feed yarns, with 160% as an approximate upper limit, based on age stability. The preferred filaments of the invention suitable as a draw feed yarn, are denoted by the "widely-spaced" \\\\\\-area, having $E_B$-values of about 90% to 120% and a ($1-S/S_m$) ratio of at least about 0.25 (below line 4). The preferred filaments of the invention suitable as direct use textile yarns are denoted by "densely-spaced" \\\\\\-area, having $E_B$-values of about 40% to 90%, and a ($1-S/S_m$) ratio of at least about 0.85 (below line 1).
Figure 2B:
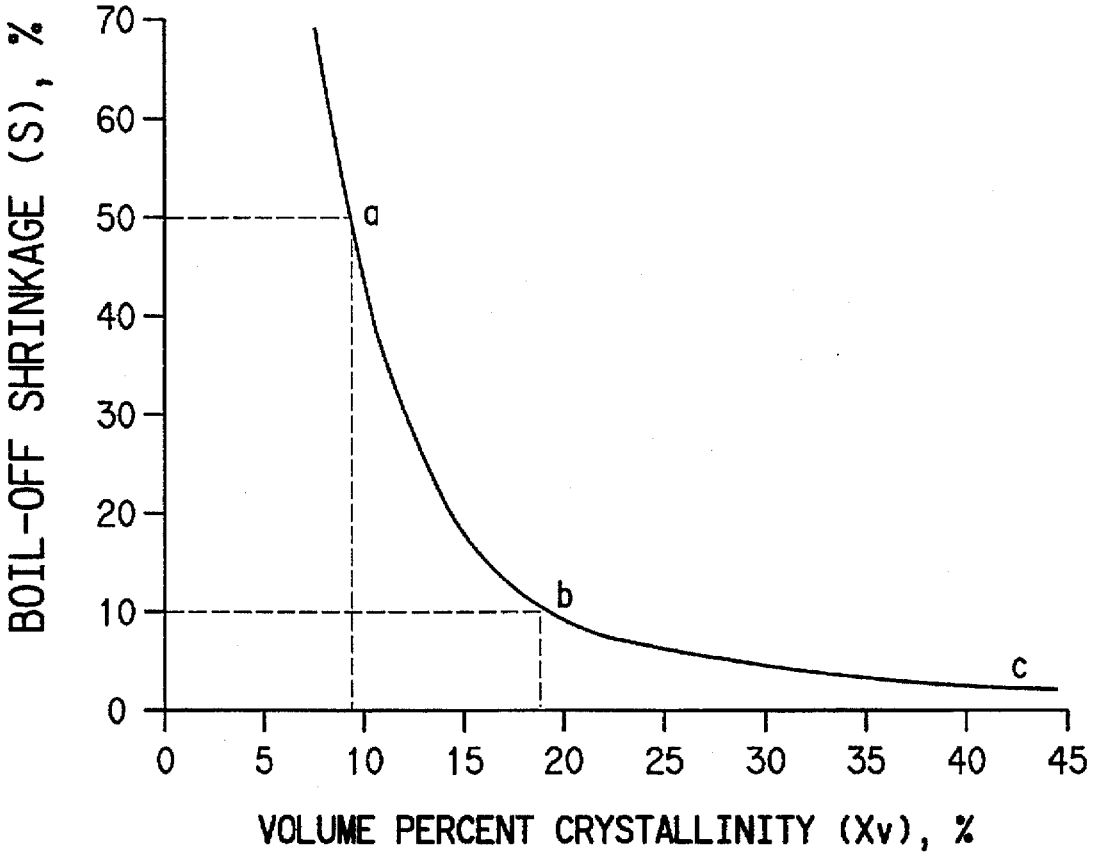
FIG. 2B is a representative plot of boil-off shrinkage (S) of spin-oriented "solid" filaments (not according to the invention) having a wide range of elongations-to-break $E_B$ from about 160% to about 40%, spun using a wide range of process conditions (e.g., filament denier and cross-section, spin speed, polymer LRV, quenching, capillary dimensions (L×D), and polymer temperature $T_P$) versus volume percent crystallinity (Xv), measured by flotation density, and corrected for % pigment. The single relationship between S and density (i.e., a measure of the extent of stress-induced crystallization of the amorphous regions during melt-spinning, SIC) obtained for yarns of such differing $E_B$-values supports the view that the degree of SIC is the primary structural event and that the degree of stress-induced orientation of the amorphous regions during melt-spinning (SIO) is a secondary structural event in this range of $E_B$-values for determining the degree of S. The range of S from about 50% to about 10% corresponding to a range of Xv of about 10 to 20% (a–b) is the preferred level of SIC for draw feed yarns and the range of less than about 10% shrinkage corresponding to Xv greater than about 20% is preferred level of SIC for direct-use tensile yarns (b–c).

The degree of stress-induced crystallization (SIC), a consequence of the extent of the SIO of the amorphous regions, is conventionally defined by the density of the polymeric material which is experimentally difficult to measure for fine filament yarns because of air entrapment between the free filaments and onto the large surface area of the fine filaments; hence, a relative measure of stress-induced crystallization (SIC) is used herein based on the extent of boil-off shrinkage (S) for a given yarn elongation-to-break ($E_B$). For a given fiber polymer crystallinity the boil-off shrinkage (S) is expected to increase with molecular extension (i.e., with decreasing elongation-to-break, $E_B$); and therefore a relative degree of stress-induced crystallization (SIC) is defined, herein, by the expression: $(1-S/S_m)$, where $S_m$ is the expected maximum shrinkage for filaments of a given degree of molecular extension ($E_B$) in the absence of crystallinity; and $S_m$ is defined herein by the expression: $S_m(\%)=([(E_B)_{max}-E_B)]/[(E_B)_{max}+100])100\%$, wherein $(E_B)_{max}$ is the expected maximum elongation-to-break ($E_B$) of totally amorphous "isotropic" filaments. For polyester filaments spun from polymer of typical textile intrinsic viscosities in the range of about 0.56 to about 0.68 (corresponding to LRV in the range of about 16 to about 23), the nominal value of $(E_B)_{max}$ is experimentally found to be about 550% providing for a maximum residual draw ratio of 6.5 (High Speed Fiber Spinning, ed. A. Ziabicki and H. Kawai, Wiley Interscience (1985), page 409) and thus, $S_m$ (%) may in turn be defined, herein, by the simplified expression: $S_m$, $\%=[(550-E_B)/650]\times100\%$ (graphically represented in FIG. 2A). The filaments of the invention are described by having a $(1-S/S_m)$ value of greater than about 0.1 (and preferably greater than about 0.25) to provide sufficient SIC for age stability) and an elongation ($E_B$) between about 40 and about 160%.

The spin-oriented mixed-filament yarns of the invention are characterized by a maximum shrinkage tension ($ST_{max}$) of less than about 0.2 g/d occurring at a shrinkage tension peak temperature $T(ST_{max})$ in the range 5° C. to about 30° C. greater than about the polymer Tg (e.g., 70°–100° C. for homopolymer 2GT with polymer Tg about 65° C.; where preferred undrawn fine mixed-filament feed yarns are further characterized by an elongation-to-break ($E_B$) in the range of about 90% to about 120%, a tenacity-at-7% elongation ($T_7$) in the range of about 0.5 to about 1 g/d; and a $(1-S/S_{max})$ -value of at least about 0.25; and especially preferred undrawn filament yarns suitable for use as direct-use yarns are further characterized by an elongation-to-break ($E_B$) in the range of about 40% to about 90%, a tenacity-at-7% elongation ($T_7$) in the range of about 1 and 1.75 g/d, and a $(1-S/S_m)$-value of at least about 0.85.

Denier per filament of a mixed-filament yarn spun from the same spinneret is determined by capillary mass flow rates, w=(Vs×dpf)/9000, through the spinneret capillary which is inversely proportional to the capillary pressure drop (herein taken as being approximately proportional $(L/D)^n/D^3$) where n has a value of 1 for Newtonian fluids, and L is the capillary length and D is capillary diameter. For non round cross-section capillaries of conventional short lengths, the value of $(L/D)^n/D^3$ is taken from that of the metering capillary that feeds the polymer into the shape determining exit orifice; such that, $(dpf)_1\times[(L/D)^n/D^3]_1=(dpf)_2\times[(L/D)^n/D^3]_2$ and therefore the ratio $(dpf)_2/(dpf)_1]=[(L/D)^n/D^3]1/[(L/D)^n/D^3]^2$. For example, co-spinning using spinnerets with metering capillaries of 15×72 mils and 8×32 mils, will provide filaments of mixed dpf in the ratio $(dpf)_2/(dpf)_1$) of about 476.7 $mm^3$/86.5 $mm^2$ (=5.5) for a value of n about 1.1 for the range of process conditions used herein. If spinning filaments of different cross-section, but of the same dpf, it may be required that the metering capillaries be of slightly different dimensions (i.e., of different $[(L/D)^n/D^3]$-values so to overcome any small, but meaningful, differences in the pressure drop of the shape forming exit orifices. However, if spinning the different filament components from separate spin packs and combining them into a single mixed-filament bundle, for example; then the dpf of the filaments from a given spin pack is independent of pack pressure and spinneret dimensions and is simply given by: dpf=9000W/$(V_s\#_F)$, where W is the total spin pack mass flow rate (g/rain), $\#_F$ is the number (#) of filaments (F) per spin pack, and $V_s$ is the withdrawal speed expressed as m/min. This discussion, as will be clear to those skilled in the art, refers to differences in the configurations of the spinneret capillaries to provide filaments that differ in denier and/or cross-section significantly enough to obtain the desired results in the eventual textile mixed filament yarns (which may be as-spun or drawn).

In particular the invention includes, but is not limited to, the following processes (and products therefrom):

(1) A spin-orientation process of the invention provides spin-oriented polyester undrawn fine mixed-filament yarns, wherein the polyester polymer is characterized by a relative viscosity (LRV) in the range of about 13 to about 23, a zero-shear melting point ($T_M^o$) in the range of about 240° C. to about 265° C., and a glass-transition temperature ($T_g$) in the range of about 40° C. to about 80° C.; and wherein the mixed-filament yarn, comprised of two or more filament components that differ in cross-section and/or denier such that at least one filament component has a filament denier less than about 1 (preferably having an average yarn spun filament denier $(dpf)_s$ such that the average drawn yarn filament denier $(dpf)_D$ is less than about 1, where $(dpf)_D$ is defined by $\{(dpf)_s\times[(1.3)/(1+Eb/100)_s\}$; and especially where the undrawn yarn average filament denier $(dpf)_s$ is less than about 1, such that for mixed-denier yarns the filament denier ratio of the high denier filaments (2) to the low denier filaments (1) is about 2 to about 6; and further characterized by: a maximum dry heat shrinkage tension $ST_{max}$ less than about 0.2 g/d at a dry heat shrinkage tension peak temperature $T(ST_{max})$ about 5° C. to about 30° C. greater than about the polymer glass-transition temperature $T_g$; a $(1-S/S_m)$ value at least about 0.1 (and preferably at least about 0.25) to provide age stability shrinkage; an elongation-to-break ($E_B$) about 40% to about 160% (preferably about 90% to about 120% for draw feed yarns wherein there is essentially no loss of void content on drawing, and especially about 40% to about 90% with a $(1-S/S_m)$ value of at least about 0.85 for use as draw feed yarn or as an undrawn direct-use yarn); a tenacity-at-7% elongation ($T_7$) in the range of about 0.5 and about 1.75 g/d (preferably in the range of about 0.5 to about 1 g/d for a draw feed yarn and especially in the range of about 1 to about 1.75 for use as a direct-use yarn); and a break tenacity $(T_B)_n$, normalized to 20.8 LRV, at least about 5 g/d (preferably at least about 6 g/d); and preferably having a thermal stability ($S_2$) as shown by a difference (DHS–S) of less than +2%.

The spin-orientation process is characterized by:

(i) the polyester polymer is selected to have a relative viscosity (LRV) in the range of about 13 to about 23, a zero-shear melting point ($T_M^o$) in the range about 240° C. to about 265° C., and a glass-transition temperature ($T_g$) in the range of about 40° C. to about 80° C.; said polymer is melted and heated to a temperature ($T_P$) in the range about 25° C. to about 55° C. above the apparent polymer melting point $(T_M)_a$ and filtered sufficiently rapidly to minimize degradation; and then extruded through spinneret capillaries selected to have a cross-sectional area ($A_c$) in the range about $125\times10^{-6}$ $cm^2$ to about $1250\times10^{-6}$ $cm^2$, and a length (L) and diameter ($D_{RND}$) such that the $(L/D_{RND})$-ratio is at least about 1.25 and less than about 6 (preferably less than about 4) and wherein the exit orifice shapes and/or capillary L and D values are selected to provide filaments of differing cross-section and/or denier (as described herein before);

(ii) the extruded melt is protected from direct cooling as it emerges from the spinneret capillary over a distance ($L_{DQ}$)

of at least about 2 cm and less than about $[12(dpf)_1^{1/2}]$ cm; cooled to below the polymer glass-transition temperature ($T_g$) and attenuating the finer filaments to an apparent spinline strain in the range of about 5.7 to about 7.6, where $(dpf)_1$ is that of the finer filament of the mixed-filament yarn;

(iii) the mixed-filaments are then converged into a mixed-filament bundle by use of a low friction surface at a distance ($L_c$) in the range about 50 cm to about $[90(dpf)_1^{1/2}]$ cm; interlaced to provide filament bundle integrity and then winding up the mixed-filament yarn at a withdrawal speed ($V_s$) in the range of about 2 to about 6 km/min;

(2) Coupled spin/draw processes or split spin/draw processes, such as described by Knox and Noe in U.S. Pat. No. 5,066,447; including draw texturing process (e.g., draw false-twist texturing and draw air-jet texturing) for preparing:

(i) drawn flat or air-jet textured mixed-filament yarns, having a differential filament shrinkage of at least 5%, prepared by drawing the undrawn mixed-filament yarns at a temperature above the glass-transition temperature (Tg) and less than about the onset temperature of major crystallization ($T_c^o$) of the polyester polymer and farther characterized by a residual elongation-to-break ($E_B$) about 15% to about 45%, and a tenacity-at-7% elongation ($T_7$) at least about 1 g/d; and especially drawn mixed-filament flat and air-jet textured yarns having a differential shrinkage of at least 5% by cold drawing without post heat setting the undrawn direct-use mixed-filament yarns, described herein above and wherein the cold drawn differential mixed-filament yarns are further characterized by a residual elongation-to-break ($E_B$) about 15% to about 55%, and a tenacity-at-7% elongation ($T_7$) at least about 1 g/d.

(ii) drawn polyester flat and textured free mixed-filament yarns, prepared from the undrawn free mixed-filament feed yarns of the invention as described hereinbefore, are characterized by an elongation-to-break ($E_B$) about 15 to about 45%, a $(1-S/S_m)$ value at least about 0.85, a tenacity-at-7% elongation ($T_7$) at least about 1 g/d, preferably a post-yield modulus ($M_{py}$) about 5 to about 25 g/d; and preferably wherein the drawn flat fine-mixed filament yarns are further characterized by an along-end uniformity as measured by an along-end denier spread (DS) of less than about 3% (especially less than about 2%).

(iii) preferred polyester mixed-filament yarns of an average yarn filament denier less than about 1 and of a residual elongation-to-break ($E_B$) about 15% to about 55%, $(1-S/S_m)$ value at least about 0.85, tenacity-at-7% elongation ($T_7$) at least about 1 g/d, and preferably a post-yield modulus ($M_{py}$) about 5 to about 25 g/d, prepared by cold or hot drawing with or without post heat treatment in single-end split or coupled processes or in a form of a weftless warp sheet, and the undrawn mixed-filament yarns especially having a residual elongation of about 40% to about 90% with a $(1-S/S_m)$ value of at least about 0.85 for use as an undrawn direct-use yarn); a tenacity-at-7% elongation ($T_7$) in the range of about 1 and about 1.75 g/d by selecting a spin-oriented mixed-filament feed yarn of the invention wherein all the filaments are characterized by the undrawn direct-use mixed-filament yarns of the invention, as described herein before; and preferably wherein the drawn flat fine-mixed filament yarns are further characterized by an along-end uniformity as measured by an along-end denier spread (DS) of less than about 3% (especially less than about 2%).

(iv) uniform drawn air-jet textured free mixed-filament yarns and uniform drawn textured fine mixed-filament yarns; wherein the process is comprised of uniformly draw air-jet texturing or draw false-twist texturing the undrawn mixed-filament feed yarns, formed by the spin-orientation process described hereinabove, to provide uniform drawn bulky mixed-filament yarns characterized by a residual elongation-to-break ($E_B$) about 15% to about 45%, a $(1-S/S_m)$ value of at least about 0.85, a tenacity-at-7% elongation ($T_7$) at least about 1 g/d, and preferably a post-yield modulus ($M_{py}$) about 5 to about 25 g/d.

(v) drawn bulky mixed-filament yarns having differential filament shrinkage of at least 5% on heat relaxing drawn flat mixed-filament yarns or drawn air-jet textured mixed-filament yarns of the invention prepared by cold drawing without post heat treatment the undrawn mixed-filament direct-use yarns of the invention, as described herein before, so to provide uniform drawn bulky mixed-filament yarns characterized by a residual elongation-to-break ($E_B$) about 15% to about 55%, a $(1-S/S_m)$ value of at least about 0.85, a tenacity-at-7% elongation ($T_7$) at least about 1 g/d, and a preferably post-yield modulus ($M_{py}$) about 5 to about 25 g/d.

(vi) drawn bulky mixed-filament yarns having differential filament shrinkage of at least 5% on heat relaxing drawn flat mixed-filament yarns or drawn air-jet textured mixed-filament yarns of the invention prepared by drawing without post heat treatment the undrawn mixed-filament yarns of the invention at a draw tempterature in the range of above $T_g$ and less than about $T_c^o$, as described herein, so to provide uniform drawn bulky mixed-filament yarns characterized by a residual elongation-to-break ($E_B$) about 15% to about 45%, a $(1-S/S_m)$ value of at least about 0.85, a tenacity-at-7% elongation ($T_7$) at least about 1 g/d, and a post-yield modulus ($M_{py}$) about 5 to about 25 g/d.

(vii) drawn yarns with shrinkage tensions ($ST_{max}$) greater than about 0.25 g/d for use in tightly constructed fabrics so to permit the yarns to overcome yarn-to-yarn restraints within the fabric during dyeing and finishing by drawing the undrawn mixed-filament yarns of the invention at temperatures above the glass transition temperature $T_g$ and less than about the onset temperature of major crystallization ($T_c^o$), wherein post heat treatment is adjusted to provide desired balance of Shrinkage S and Shrinkage Tension ST.

The drawn yarns of the invention will desirably have a minimum $T_7$ value of at least about 1 g/d, and may range upwards as high as desired, as will be understood by those skilled in the art, and may be as high as 4 g/d, depending on what is desired.

The fine denier flat filaments of the invention are further characterized by an along-end yarn denier variation [herein called Denier Spread, DS] that is less than about 4% (preferably less than about 3%, especially less than 2%); making the uniform denier free mixed-filament yarns suitable in textile fabrics requiring critical dye (configurational) uniformity; and nonround filaments (incorporated for enhanced tactile and visual aesthetics, and comfort) have a shape factor (SF) at least about 1.25, wherein the shape factor (SF) is defined by the ratio of the measured filament perimeter ($P_M$) and the calculated perimeter ($P_{RND}$) for a round filament of equivalent cross-sectional area. The filaments of the invention are further characterized by being of good mechanical quality with a tenacity-at-break $(T_B)_n$ normalized to 20.8 LRV.

TEST METHODS

Many of the polyester parameters and measurements mentioned herein are fully discussed and described by Knox in U.S. Pat. No. 4,156,071, Knox and Noe in U.S. Pat. No. 5,066,447, and Frankfort and Knox in U.S. Pat. No. 4,434, 882, all of which are hereby specifically incorporated herein by reference, so further detailed discussion, herein would, therefore be redundant. For clarification, herein, boil-off shrinkage is given by "S" (sometimes by $S_1$, or by S1 in the Tables); the thermal stability (DHS–S) of the as-spun yarns in all the Examples is always less than +2; $T_B$ (sometimes $T_b$ in Tables) is the tenacity based on denier at break (i.e., based on the drawn denier, as is $M_{py}$) $T_b$ being defined by the product of conventional textile tenacity and the residual draw ratio RDR (=1+$E_B$/100) and the normalized $(T_B)_n$ is defined by $[(T_B)(20.8/LRV)^{0.75}(1\text{-}\%\ \text{delusterant}/100)^{-4}]$. The mixed filament yarns of the invention are characterized by $T_B$-values, normalized to 20.8 polymer LRV, at least about 5 g/d, and preferably at least about 6 g/d.

The values of a polymer's glass-transition temperature $T_g$, temperature at the onset of major crystallization $T_c^o$, and temperature at the maximum rate of crystallization $T_{c,max}$ may be determined by conventional DSC analytical procedures; but the values may also be estimated from the polymer's zero-shear melting point $T_M^o$ (expressed in degrees Kelvin) for a given class of chemistry, such as polyesters using the approach taken by R. F. Boyer [Order in the Amorphous State of Polymers, ed. S. E. Keinath, R. L. Miller, and J. K. Riecke, Plenum Press (New York), 1987]; wherein, $T_g$=0.65 $T_M^o$; $T_c^o$=0.75 $T_M^o$; and $T_{c,max}$= 0.85 $T_M^o$; wherein all temperatures are expressed in degrees Kelvin.

Various embodiments of the processes and products of the invention are illustrated by, but not limited to, the following Examples with details summarized in the Tables.

EXAMPLE A

In Example A Mixed filament yarns were prepared by co-spinning low denier filaments with higher denier filaments (such as low shrinkage (crystalline) spin-oriented filaments of, e.g., Knox U.S. Pat. No. 4,156,071, and/or high shrinkage (amorphous) spin-oriented POY filaments of Piazza and Reese U.S. Pat. No. 3,772,872 to provide potential for mixed-shrinkage (e.g., post-bulking in fabric) such as when low shrinkage filaments are combined with high shrinkage filaments).

Such high and low dpf filaments may be spun from separate pack cavities and then combined to form a single mixed-dpf filament bundle, but are preferably spun from a single pack cavity, wherein the capillary dimensions (L and D) and the number of capillaries $\#_c$ are selected to provide for differential mass flow rates; e.g., by selecting capillaries such that the ratio of spun filament deniers, $[(dpf)_2/(dpf)_1]$, is approximately equal to $[(L1D_2/L_2D_1]^n\times[(D_2/D_1)^3]$, where 1 and 2 denote filaments of differing deniers; n=1 for Newtonian polymer melts (and herein "n" is experimentally found to have an average value of 1.1 for the polymer and process conditions used herein; and; wherein the measured average yarn filament denier is defined by: $(dpf)_{avg.}=[(\#_1dpf_1+\#_2dpf_2)/(\#_1+\#_2)]$.

Examples 1–6 Yarns were spun from 2GT homopolymer of nominal 21.2 LRV at a polymer temperature ($T_P$) of about 290° C.; quenched using a radial quench fitted with a 1.2 inch (2.75 cm) delay tube and using room temperature air at a velocity of about 40–50 mpm; then converged at a distance about 109 cm from the face of the spinneret using a metered finish applicator guide and then withdrawn at speeds as indicated in Tables I to III to form 200-filament yarns of nominal denier varying from about 127 to about 239 as indicated. The "Spun DPF Avg" is such nominal denier divded by 200. The "DPF Ratio" is the ratio of measured high dpf to measured low dpf (and was fairly close to the nominal dpf ratio of 3.54, mentioned hereinafter). The 200-filament as spun yarns comprised 24 high dpf filaments (2) and 176 low dpf filaments (1). The nominal $(dpf)_2/(dpf)_1$-ratio was about 3.54, for Examples 1–3 respectively, as a consequence of using spinneret capillaries of different dimensions; that is 24 capillaries of length (L) 39 mils (0.914 mm) and diameter (D) 12.5 mils (0.318 mm) and 176 capillaries of length (L) 36 mils (0.914 mm) and diameter (D) 9 mils (0.229 mm) such to provide a pressure drop-ratio ratio of 3.54; that is, $(dpf)_2/(dpf)_1=[(L_1D_2/L_2D_1]^n\times[D_2/D_1)^3]$, where "n" is 1 for Newtonian fluids and found experimentally to have a value of 1.1 for polymer LRV and process conditions used herein. The measured average yarn denier= $\#_1(dpf)_1+\#_2(dpf)_2=\#_1(dpf)_1+\#_2\{[(dpf)_2/(dpf)_1](dpf)_1\}=\#_1(dpf)_1+3.54[\#_2(dPf)_1]=[\#_1+3.54(\#_2)](dpf)_1=[24+3.54(176)(dpf)_1$, where $(dpf)_1$=measured average yarn denier/[24+3.54(176)] and $(dpf)_2=3.54\ (dpf)_1$].

In Example 1, the high dpf filaments (2) were spun from capillaries positioned on the outer rings of a multi-ring capillary array (because of an earlier expectation that the high dpf filaments would benefit from more quenching than the smaller dpf filaments). In Example 2 the capillaries for the high dpf filaments (2) were positioned in the middle of the array, where such spin filaments (2) would naturally tend to "migrate" during quenching and convergence. In Example. 3, the capillaries for the high dpf filaments (2) were arranged symmetrically throughout the capillaries of the multi-ring array. The data for Examples 1 to 3 are in Tables I to III, and include a column "Drawn DPF Avg" calculated from values on drawn yarns referred to in Example 4–6 and given in Tables IV to VI as "Drawn Den", divided by 200.

Surprisingly we found in practice that the symmetric array of Example 3 provided the best denier uniformity, generally, and the outer array of Example 1 the worst. The break tenacities ($T_B$) for the symmetric (3) and outer ring (1) arrays were essentially equal, while the inner array (2) was significantly worse.

In Examples 4–6 the spun yarns of Examples 1–3, respectively, were carefully warp drawn at 400 mpm, using draw and set temperatures of 180° C., to residual elongations between 25% and 45% having a nominal average yarn filament $(dpf)_D$ less than 1 dpf. The same relative order of uniformity and break tenacity was observed for the drawn yarns as for the spun feed yarns of Examples 1 to 3. The optimum filament array will depend on number of filaments, the dpf-ratio, and the desired balance of along-end denier uniformity (DS) and tensile strength (as measured here by $T_B$). The properties are summarized in Tables IV through VI, respectively, for yarns from Examples 4–6.

In the next series, instead of mixing the filaments, separate yarn bundles of high dpf and low dpf were made and drawn separately to provide data on the filament properties and behavior, it being understood that the filament could have been mixed together.

EXAMPLE 7

Individual bundles of 50 high dpf and of 200 low dpf filaments were spun from separate spin packs using 15×60 and 9×36 mil capillaries, respectively; and wound up separately (data summarized in Table VII). The resulting low dpf filaments had higher tensiles (Modulus, $T_7$, Ten.) and lower break elongations ($E_B$) than the high dpf filaments. Based on warp-drawing and draw-texturing experience, we selected a dpf-ratio of a 4 to 1 to provide the higher dpf filaments with a drawn dpf of about 2 for fine fabrics to avoid "glitter" from differential reflections off the different size filament surfaces of different curvature; a 4-to-1 dpf-ratio provided a difference in $E_B$-values of about 20% to about 40%, but a lower difference in $E_B$-values would generally be preferred to provide optimum drawn yarn mechanical properties and uniformity.

EXAMPLE 8

The yarns of Example 7 were drawn at 400 m/min for draw ratio series of 1.4×, 1.5×, and 1.6× at a draw temperature of about 180° C. and a set temperature of about 180° C. The drawn elongations generally differed about 10–20%, the higher dpf filaments having the higher elongations. The drawn yarn data is summarized in Table VIII.

EXAMPLE 9

The 172 denier 200-filament and the 172 denier 50-filament bundles from Example 7 were drawn at 400 mpm and a constant draw-ratio of 1.64 with the set plate initially at room temperature (25° C., items 1 and 2). The draw temperature was increased from room temperature (cold draw) to 180° C. (i.e., about the temperature of maximum rate of crystallization $T_{c,max}$ for 2GT polyester), and as indicated in Table IX. The shrinkages decreased with increasing draw temperature, especially above about 120° C. (onset of major crystallization $T_c^o$), and so the differential shrinkage decreased to about 2% at 130° C. This showed it was possible to provide at higher draw temperatures drawn mixed-denier filament yarns that were flat (i.e., not bulked, because the mixed dpf filaments had similar shrinkage) from the same mixed-denier feed stock, we used to produce mixed shrinkage drawn yarns, capable of self-bulking when drawn at lower draw temperatures.

EXAMPLE 10

In Example 10, for items 1 to 11, a nominal 200—200 spun yarn comprised of 24 filaments of an average dpf of 2.58 and 176 filaments of an average dpf of 0.78 was warp drawn at 1.64× draw-ratio at 400 mpm with the set plate at room temperature (25° C.), and the draw temperature was increased from 25° C. to 180° C. As the draw temperature increased, the shrinkage $S_1$ decreased from 47.2% to 5.8%. The decrease in shrinkage $S_1$ after a draw temperature of about 114° C. was minimal, which supports the results of Example 9. In Items 12 and 13 a 127 denier feed yarn comprised of 24 filaments of 1.65 dpf and 176 filaments of 0.5 dpf was drawn 1.4×. Item 12 was drawn cold and without post heat treatment (i.e., set plate remained at room temperature of about 25° C.). In Item 13 the 127 denier yarn was drawn at 180° C. and set at 180° C. giving a shrinkage $S_1$ of 5.9 versus 28.4 for Item 12. This illustrates the degree to which the shrinkage may be controlled by selection of drawn set temperatures. Data for Example 10 is summarized in Table X.

EXAMPLE 11

127–200 and 159–200 (denier-filament) yarns of Example 3 (24 high dpf and 174 low dpf) were draw air-jet textured at 200 m/min using 1.4× and 1.6× draw-ratios and the draw and set temperatures were varied from room temperature (i.e., heater switched off) to 180° C. It was possible to prepare draw air-jet textured yarns with shrinkages less than 2% and as high as about 40% which provides the potential for preparing mixed-shrinkage yarns from the same feed stock. Data is summarized in Table XI.

EXAMPLE 12

Nominal 200 denier-200 filament as spun yarns (items 5–8 from Table III) were draw false-twist textured at 180° C. on a Barmag FK6-900L at 450 m/min with a 1.506 draw ratio and a 1.707 D/Y-ratio using a 1/7/11313 disk stack (PU disk type). The drawn yarn denier was 136.7 (0.68 dpf) at a 40.6% elongation with a 3.66 g/d tenacity and a 20.7 g/d modulus. The boil-off shrinkage was 5.6% and the Leesona skein shrinkage (a measure of textured yarn bulk) was 23.7%. The mixed dpf filament yarns provided higher bulk than the 100% micro-denier filament yarns and depending on final elongation-to-break, a pleasing heather yarn could be made.

EXAMPLE 13

A spun feed yarn as for Example 12 was warp drawn at 400 m/min using a pre-draw temperature of 75° C. and drawing 1.64× at a draw temperature of 115° C. (about the cold crystallization temperature $T_{cc}$) providing a 10% boil-off shrinkage. The drawn yarn denier at a 37.5 % elongation was 124.8 (average filament $(dpf)_D$ of 0.62) and a tenacity of 3.98 g/d with a modulus of 66.8 g/d and a $T_7$ of 2.47 g/d. The free denier yarns had a denier spread of 2.2% and slow Uster of 0.6% making these yarns suitable for critically dyed end-uses.

EXAMPLE 14

A mixed filament yarn was prepared by cospinning 50 1.83 denier filaments of shrinkage $S_1$ of 21%, giving a $(1-S_1/S_m)$-ratio of 0.67, and 200 filaments of 0.46 denier having a shrinkage $S_1$ of 5.2%, giving a $(1-S_1/S_m)$-ratio of 0.92, at 2743 mpm to provide a post-bulkable mixed-shrinkage yarn (refer to Items 17 and 18 of Table VII). A similar post-bulkable yarn with shrinkages of 7.8% and 39.4% was prepared by co-spinning at 2743 mpm 50 filaments of 2.28 dpf and 200 filaments of 0.57 dpf (Items 13 and 14 of Table VII). At lower spin speeds the shrinkage of the lower dpf filaments increased to reduce the difference in shrinkages between the low and high dpf filaments and to give excessive fabric loss. It is preferred that the low shrinkage filaments have shrinkages less than about 10%, that is, having $(1-S_1/S_m)$-values of at least about 0.85, as illustrated in Items 13 and 17 of Table VII, to provide for mixed-shrinkage and to minimize fabric loss which is, at most, equal to the shrinkage of the high shrinkage component if the high shrinkage component has sufficient shrinkage tension to overcome the restraints in the fabric. To minimize fabric loss on post-bulking in fabric form, the bulking can take place during warping by overfeeding at the temperatures sufficient to develop shrinkage and bulk; but preferably leaving some residual shrinkage for development of bulk in fabric form which helps to randomize differences in stitch tightness and improves configurational uniformity. About 3–4% residual shrinkage is sufficient for warp knits and light weight wovens.

EXAMPLE 15

200 (mixed-)filament yarns were spun from 2GT homopolymer of nominal 21.2 LRV at a polymer temperature ($T_P$) of about 290° C. and quenched using a radial quench fitted with a 1.7 inch (4.32 cm) delay tube and using room temperature air at a velocity of about 30–50 mpm, then converged at a distance about 109 cm from the face of the spinneret using a metered finish applicator guide and then withdrawn to form 200-filament yarns of nominal denier varying from about 124 denier to about 220 denier, wherein the 200-filament yarns are comprised of 24 high dpf filaments having non-round cross section and 176 low dpf filaments of round cross-section. The spinneret capillaries used for producing the 176 low dpf filaments have a capillary length (L) of 36 mils (0.914 mm) and diameter (D) of 9 mils (0.229 mm). Spinneret capillaries for forming the 24 high dpf filaments were selected for shaping the fiber cross-section as desired; yarns were produced where the high dpf component had the following cross-sections: 1) trilobal, 2) octalobal, 3) multilobal ribbon, 4) hollow. A dpf ratio of about 3.5:1 was obtained by use of a metering plate having 24 capillaries with capillary length (L) of 56 mils (1.42 mm) and diameter (D) of 14 mils (0.356 mm) to control polymer delivery to the non-round forming capillaries; a low pressure drop metering plate capillary of length (L) of 90 mils (2.29 mm) and diameter (D) of 40 mils (1.02 mm) was used for the low dpf component, such that the low dpf polymer flow rate was essentially controlled by the spinneret capillary.

This process was used to provide yarns comprised of filaments of mixed-denier and of mixed cross-sectional shape, thus reducing the differential between the elongations of the low and high denier filaments, and therefore improving the co-drawing (i.e., providing both components being capable of being co-drawn to elongations between about 20% and about 40% for improved mechanical properties and denier uniformity) and producing high denier filaments of low shrinkage, thus making the mixed-filament yarn suitable for a direct-use flat yarn.

The invention lends itself to many variations and further modifications will be apparent, especially as these and other technologies advance. For example, any type of draw winding machine may be used; post heat treatment of the feed and/or drawn yarns, if desired, may be applied by any type of heating device (such as heated godets, hot air and/or steam jet, passage through a heated tube, microwave heating, etc.); finish application may be applied by convention roll application, herein metered finish tip applicators are preferred and finish may be applied in several steps, for example during spinning prior to drawing and after drawing prior to winding; interlace may be developed by using heated or unheated entanglement air-jets and may be developed in several steps, such as during spinning and during drawing and other devices may be used, such by use of tangle-reeds on a weftless sheet of yarns. Furthermore, if desired, hollow filaments spun via post-coalescence from segmented spinneret capillary orifices may be incorporated as one (or more) of the filament components in the mixed-filament yarns of the invention to provide lighter weight fabrics with greater bulk for improved fabric drape, and to provide a difference in cross-section, at least, as disclosed in allowed application Ser. No. 08/214,717 (DP-4555-H) filed Mar. 16, 1994, by Aneja et al., and the disclosure of which is hereby incorporated herein by reference.

TABLE I

| Item No. | Spun Den. | Spin Speed (mpm) | Spun DPF Avg. | DPF Ratio | DPF Low | DPF High | D.S. (%) | Ten. (g/d) | Eb (%) | Tb (g/d) | Sm (%) | Drawn DPF Avg. |
|---|---|---|---|---|---|---|---|---|---|---|---|---|
| 1 | 239 | 2195 | 1.20 | 3.44 | 0.93 | 3.21 | 1.67 | 2.36 | 145.5 | 5.79 | 62.23 | 0.63 |
| 2 | 239 | 2195 | 1.20 | 3.62 | 0.92 | 3.33 | 3.64 | 2.37 | 156.9 | 6.09 | 60.48 | 0.60 |
| 3 | 239 | 2195 | 1.20 | 3.55 | 0.92 | 3.28 | 1.45 | 2.35 | 146.5 | 5.79 | 62.07 | 0.63 |
| 4 | 212 | 2469 | 1.06 | 3.70 | 0.81 | 2.99 | 2.07 | 2.38 | 129.7 | 5.47 | 64.66 | 0.60 |
| 5 | 199 | 2195 | 1.00 | 3.43 | 0.78 | 2.67 | 1.83 | 2.53 | 139.1 | 6.05 | 63.21 | 0.54 |
| 6 | 199 | 2195 | 1.00 | 3.77 | 0.75 | 2.84 | 1.45 | 2.60 | 150.3 | 6.51 | 61.49 | 0.52 |
| 7 | 199 | 2195 | 1.00 | 3.27 | 0.79 | 2.58 | 1.88 | 2.11 | 132.7 | 4.91 | 64.20 | 0.56 |
| 8 | 199 | 2195 | 1.00 | 3.43 | 0.78 | 2.67 | 1.59 | 2.51 | 139.9 | 6.02 | 63.10 | 0.54 |
| 9 | 191 | 2743 | 0.96 | 3.41 | 0.75 | 2.55 | 2.12 | 2.75 | 125.2 | 6.19 | 65.35 | 0.55 |
| 10 | 180 | 2195 | 0.90 | 3.51 | 0.70 | 2.45 | 1.82 | 2.58 | 134.6 | 6.05 | 63.90 | 0.50 |
| 11 | 177 | 2469 | 0.89 | 3.40 | 0.69 | 2.36 | 2.11 | 2.62 | 123.7 | 5.86 | 65.58 | 0.51 |
| 12 | 159 | 2743 | 0.80 | | | | 1.91 | 2.45 | 113.0 | 5.22 | 67.23 | 0.49 |
| 13 | 159 | 2195 | 0.80 | 3.30 | 0.63 | 2.08 | 1.43 | 2.76 | 134.1 | 6.46 | 63.99 | 0.44 |
| 14 | 159 | 2195 | 0.80 | 3.36 | 0.63 | 2.10 | 1.91 | 2.58 | 126.7 | 5.85 | 65.12 | 0.46 |
| 15 | 159 | 2195 | 0.80 | 3.46 | 0.62 | 2.15 | 1.86 | 2.58 | 122.1 | 5.73 | 65.83 | 0.47 |
| 16 | 142 | 2469 | 0.71 | 3.27 | 0.56 | 1.84 | 1.42 | 2.70 | 124.9 | 6.07 | 65.40 | 0.41 |
| 17 | 127 | 2743 | 0.64 | 3.55 | 0.49 | 1.74 | 2.23 | 2.71 | 101.4 | 5.46 | 69.02 | 0.41 |

TABLE II

| Item No. | Spun Den. | Spin Speed (mpm) | Spun DPF Avg. | DPF Ratio | DPF Low | DPF High | D.S. (%) | Ten. (g/d) | Eb (%) | Tb (g/d) | Sm (%) | Drawn DPF Avg. |
|---|---|---|---|---|---|---|---|---|---|---|---|---|
| 1 | 239 | 2195 | 1.20 | 3.82 | 0.87 | 3.34 | 2.19 | 2.15 | 157.6 | 5.54 | 60.37 | 0.60 |
| 2 | 239 | 2195 | 1.20 | 3.23 | 0.93 | 2.99 | 3.08 | 2.09 | 153.2 | 5.29 | 61.05 | 0.61 |
| 3 | 239 | 2195 | 1.20 | 3.49 | 0.90 | 3.15 | 1.97 | 2.09 | 151.2 | 5.25 | 61.35 | 0.62 |
| 4 | 212 | 2469 | 1.06 | 3.83 | 0.77 | 2.97 | 2.20 | 2.14 | 137.7 | 5.09 | 63.43 | 0.58 |
| 5 | 199 | 2195 | 1.00 | 3.62 | 0.74 | 2.69 | 1.81 | 2.01 | 136.8 | 4.76 | 63.57 | 0.55 |
| 6 | 199 | 2195 | 1.00 | 3.63 | 0.74 | 2.69 | 2.54 | 1.91 | 141.7 | 4.62 | 62.82 | 0.54 |
| 7 | 199 | 2195 | 1.00 | 3.15 | 0.78 | 2.45 | 1.84 | 2.24 | 133.8 | 5.24 | 64.02 | 0.55 |
| 8 | 199 | 2195 | 1.00 | 3.27 | 0.77 | 2.51 | 2.22 | 1.97 | 126.2 | 4.46 | 65.21 | 0.57 |
| 9 | 191 | 2743 | 0.96 | 3.52 | 0.72 | 2.53 | 3.07 | 2.41 | 122.6 | 5.36 | 65.76 | 0.56 |
| 10 | 180 | 2195 | 0.90 | 3.50 | 0.68 | 2.38 | 2.14 | 2.08 | 125.7 | 4.69 | 65.28 | 0.52 |
| 11 | 177 | 2469 | 0.89 | 3.11 | 0.69 | 2.16 | 2.19 | 2.18 | 124.6 | 4.90 | 65.45 | 0.51 |
| 12 | 159 | 2743 | 0.80 | 3.85 | 0.58 | 2.23 | 1.60 | 2.72 | 117.4 | 5.91 | 66.56 | 0.48 |

TABLE II-continued

| Item No. | Spun Den. | Spin Speed (mpm) | Spun DPF Avg. | DPF Ratio | DPF Low | DPF High | D.S. (%) | Ten. (g/d) | Eb (%) | Tb (g/d) | Sm (%) | Drawn DPF Avg. |
|---|---|---|---|---|---|---|---|---|---|---|---|---|
| 13 | 159 | 2195 | 0.80 | 3.29 | 0.61 | 2.0J | 2.07 | 2.47 | 135.4 | 5.81 | 63.79 | 0.44 |
| 14 | 159 | 2195 | 0.80 | 3.72 | 0.59 | 2.19 | 2.33 | 2.22 | 125.5 | 5.01 | 65.31 | 0.46 |
| 15 | 159 | 2195 | 0.80 | 3.75 | 0.59 | 2.19 | 1.45 | 2.30 | 121.2 | 5.09 | 65.97 | 0.47 |
| 16 | 142 | 2469 | 0.71 | 3.63 | 0.53 | 1.92 | 2.15 | 2.19 | 105.8 | 4.51 | 68.34 | 0.45 |
| 17 | 127 | 2743 | 0.64 | 3.64 | 0.47 | 1.72 | 1.65 | 2.09 | 89.9 | 3.97 | 70.78 | 0.43 |

TABLE III

| Item No. | Spun Den. | Spin Speed (mpm) | Spun DPF Avg. | DPF Ratio | DPF Low | DPF High | D.S. (%) | Ten. (g/d) | Eb (%) | Tb (g/d) | T7 (g/d) | T20 (g/d) | SI (%) | Sm (%) | 1-SI/ Sml | Drawn DPF Avg. |
|---|---|---|---|---|---|---|---|---|---|---|---|---|---|---|---|---|
| 1 | 239 | 2195 | 1.20 | 3.91 | 0.89 | 3.46 | 1.62 | 2.48 | 154.4 | 6.31 | 0.61 | 0.57 | 56.2 | 60.87 | 0.04 | 0.61 |
| 2 | 239 | 2195 | 1.20 | 3.35 | 0.93 | 3.12 | 2.10 | 2.41 | 156.9 | 6.19 | 0.62 | 0.56 | 56.6 | 60.46 | 0.06 | 0.60 |
| 3 | 239 | 2195 | 1.20 | 3.85 | 0.89 | 3.43 | 1.58 | 2.35 | 148.6 | 5.84 | 0.61 | 0.56 | 57.4 | 61.75 | 0.07 | 0.62 |
| 4 | 212 | 2469 | 1.06 | 3.47 | 0.82 | 2.64 | 1.57 | 2.54 | 134.6 | 5.96 | 0.64 | 0.60 | 55.6 | 63.91 | 0.13 | 0.59 |
| 5 | 199 | 2195 | 1.00 | 3.55 | 0.76 | 2.70 | 1.56 | 2.56 | 144.9 | 6.27 | 0.63 | 0.61 | 52.1 | 62.33 | 0.16 | 0.53 |
| 6 | 199 | 2195 | 1.00 | 3.74 | 0.75 | 2.80 | 1.59 | 2.61 | 149.5 | 6.51 | 0.59 | 0.53 | 55.3 | 61.62 | 0.10 | 0.52 |
| 7 | 199 | 2195 | 1.00 | 3.31 | 0.78 | 2.56 | 1.56 | 2.55 | 140.3 | 6.13 | 0.62 | 0.61 | 54.5 | 63.03 | 0.14 | 0.54 |
| 8 | 199 | 2195 | 1.00 | 3.49 | 0.77 | 2.67 | 1.75 | 2.47 | 138.6 | 5.89 | 0.62 | 0.61 | 51.6 | 63.30 | 0.18 | 0.54 |
| 9 | 191 | 2743 | 0.96 | 3.40 | 0.74 | 2.52 | 1.72 | 2.71 | 123.9 | 6.07 | 0.66 | 0.69 | 45.3 | 65.55 | 0.31 | 0.55 |
| 10 | 180 | 2195 | 0.90 | 3.67 | 0.66 | 2.50 | 1.68 | 2.46 | 128.6 | 5.63 | 0.59 | 0.61 | 52.8 | 64.60 | 0.21 | 0.51 |
| 11 | 177 | 2469 | 0.89 | 3.22 | 0.70 | 2.25 | 1.40 | 2.61 | 123.7 | 5.84 | 0.66 | 0.65 | 46.6 | 65.58 | 0.29 | 0.51 |
| 12 | 159 | 2743 | 0.80 | 3.63 | 0.59 | 2.27 | 2.09 | 2.44 | 115.0 | 5.25 | 0.79 | 0.66 | 53.1 | 66.93 | 0.21 | 0.48 |
| 13 | 159 | 2195 | 0.80 | 3.19 | 0.63 | 2.01 | 1.52 | 2.72 | 133.4 | 6.35 | 0.63 | 0.64 | 50.7 | 64.09 | 0.21 | 0.44 |
| 14 | 159 | 2195 | 0.80 | 3.72 | 0.60 | 2.23 | 1.65 | 2.62 | 137.0 | 6.21 | 0.63 | 0.63 | 53.4 | 63.54 | 0.16 | 0.44 |
| 15 | 159 | 2195 | 0.80 | 3.45 | 0.61 | 2.12 | 1.60 | 2.60 | 127.2 | 5.91 | 0.66 | 0.65 | 50.5 | 65.04 | 0.22 | 0.45 |
| 16 | 142 | 2469 | 0.71 | 3.40 | 0.55 | 1.87 | 1.64 | 2.42 | 111.1 | 5.11 | 0.73 | 0.77 | 34.0 | 67.52 | 0.50 | 0.44 |
| 17 | 127 | 2743 | 0.64 | 3.32 | 0.50 | 1.65 | 1.28 | 2.68 | 101.4 | 5.40 | 0.8S | 0.97 | 11.7 | 69.01 | 0.63 | 0.41 |

TABLE IV

| Item No. | Feed Den. | Drawn Den. | Draw Ratio | Mod. (g/d) | T7 (g/d) | Ten. (g/d) | Eb (%) | Tb (g/d) | WTB (g/d) | SI (%) | D.S. (%) |
|---|---|---|---|---|---|---|---|---|---|---|---|
| 1 | 199 | 126.6 | 1.60 | 79.1 | 2.45 | 4.17 | 34.70 | 5.62 | 136.0 | 5.30 | 2.22 |
| 2 | 199 | 125.4 | 1.62 | 80.2 | 2.59 | 4.11 | 31.21 | 5.39 | 120.6 | 4.95 | 2.23 |
| 3 | 199 | 124.0 | 1.64 | 79.7 | 2.71 | 4.23 | 31.50 | 5.56 | 125.0 | 5.10 | 1.92 |
| 4 | 199 | 126.9 | 1.60 | 69.5 | 2.39 | 4.11 | 34.68 | 5.54 | 132.2 | | |
| 5 | 199 | 127.1 | 1.60 | 70.6 | 2.53 | 4.14 | 33.68 | 5.53 | 131.9 | | |
| 6 | 177 | 120.6 | 1.50 | 76.0 | 2.52 | 4.15 | 37.52 | 5.71 | 141.0 | | |
| 7 | 159 | 115.8 | 1.40 | 77.1 | 2.27 | 4.07 | 45.74 | 5.93 | 156.7 | | |
| 6 | 239 | 151.9 | 1.60 | 72.5 | 2.13 | 3.63 | 36.10 | 5.21 | 152.6 | 5.60 | 2.67 |
| 9 | 239 | 150.5 | 1.62 | 74.3 | 2.22 | 3.66 | 34.50 | 5.19 | 146.9 | 5.30 | 2.35 |
| 10 | 239 | 148.8 | 1.64 | 72.4 | 2.26 | 3.79 | 30.60 | 4.95 | 127.0 | 5.30 | 2.50 |
| 11 | 239 | 152.4 | 1.60 | 60.4 | 1.93 | 3.54 | 36.18 | 4.82 | 140.6 | | |
| 12 | 239 | 152.6 | 1.60 | 63.4 | 2.09 | 3.72 | 34.49 | 5.00 | 141.5 | | |
| 13 | 212 | 144.9 | 1.50 | 72.6 | 2.11 | 3.95 | 43.50 | 5.67 | 180.9 | | |
| 14 | 191 | 139.8 | 1.40 | 70.2 | 2.07 | 3.73 | 42.48 | 5.31 | 161.8 | | |
| 15 | 159 | 110.5 | 1.60 | 73.6 | 3.00 | 4.56 | 35.04 | 6.16 | 124.4 | | |
| 16 | 159 | 101.7 | 1.60 | 72.7 | 2.86 | 4.45 | 34.61 | 5.99 | 116.8 | | |
| 17 | 159 | 101.7 | 1.60 | 76.6 | 3.03 | 4.42 | 31.41 | 5.81 | 106.6 | | |
| 18 | 142 | 96.3 | 1.50 | 66.0 | 2.94 | 4.27 | 34.42 | 5.74 | 109.6 | | |
| 19 | 127 | 93.0 | 1.40 | 86.5 | 2.79 | 3.71 | 31.11 | 4.66 | 87.1 | | |
| 20 | 180 | 114.1 | 1.60 | 62.8 | 2.76 | 4.28 | 33.40 | 5.71 | 124.0 | 5.90 | 1.33 |
| 21 | 160 | 113.0 | 1.62 | 63.6 | 2.66 | 4.34 | 32.03 | 5.73 | 119.4 | 6.10 | 1.62 |
| 22 | 180 | 111.6 | 1.64 | 85.0 | 3.01 | 4.40 | 31.10 | 5.77 | 117.5 | 5.75 | 1.74 |

TABLE V

| Item No. | Feed Den. | Drawn Den. | Draw Ratio | Mod. (g/d) | T7 (g/d) | Ten. (g/d) | Eb (%) | Tb (g/d) | WTB (g/d) |
|---|---|---|---|---|---|---|---|---|---|
| 1 | 199 | 127.0 | 1.6 | 56.3 | 2.25 | 3.42 | 31.78 | 4.51 | 104.3 |
| 2 | 199 | 126.8 | 1.6 | 60.1 | 2.21 | 3.42 | 34.61 | 4.60 | 114.3 |
| 3 | 199 | 126.8 | 1.6 | 57.3 | 2.30 | 3.45 | 32.24 | 4.56 | 107.4 |
| 4 | 177 | 120.3 | 1.5 | 62.3 | 2.27 | 3.48 | 36.37 | 4.75 | 116. |
| 5 | 159 | 115.9 | 1.4 | 72.3 | 2.40 | 3.85 | 40.01 | 5.39 | 135.6 |
| 6 | 239 | 152.4 | 1.6 | 54.5 | 2.01 | 3.11 | 33.11 | 4.14 | 118.9 |
| 7 | 239 | 152.2 | 1.6 | 54.1 | 1.91 | 2.95 | 31.71 | 3.89 | 107.6 |
| 8 | 239 | 152.4 | 1.6 | 57.1 | 2.00 | 3.19 | 24.51 | 3.97 | 126.0 |
| 9 | 212 | 144.7 | 1.5 | 59.9 | 1.98 | 3.12 | 34.71 | 4.20 | 117.6 |
| 10 | 191 | 139.5 | 1.4 | 59.8 | 1.92 | 3.12 | 39.25 | 4.34 | 127.8 |
| 11 | 159 | 101.5 | 1.6 | 60.9 | 2.65 | 3.81 | 31.33 | 5.00 | 93.1 |
| 12 | 159 | 101.3 | 1.6 | 57.7 | 2.52 | 3.72 | 32.20 | 4.92 | 92.5 |

TABLE V-continued

| Item No. | Feed Den. | Drawn Den. | Draw Ratio | Mod. (g/d) | T7 (g/d) | Ten. (g/d) | Eb (%) | Tb (g/d) | WTB (g/d) |
|---|---|---|---|---|---|---|---|---|---|
| 13 | 159 | 101.5 | 1.6 | 61.7 | 2.66 | 3.73 | 29.38 | 4.83 | 85.7 |
| 14 | 142 | 96.3 | 1.5 | 59.5 | 2.57 | 3.78 | 34.48 | 5.08 | 96.3 |
| 15 | 127 | 92.7 | 1.4 | 60.7 | 2.49 | 3.53 | 36.27 | 4.81 | 93.3 |

TABLE VI

| Item No. | Feed Den. | Drawn Den. | Draw Ratio | Mod. (g/d) | T7 (g/d) | Ten. (g/d) | Eb (%) | Tb (g/d) | WTB (g/d) | SI (%) | D.S. (%) |
|---|---|---|---|---|---|---|---|---|---|---|---|
| 1 | 199 | 127.2 | 1.60 | 77.6 | 2.46 | 4.06 | 34.29 | 5.45 | 131.8 | 5.70 | 1.74 |
| 2 | 199 | 126.1 | 1.62 | 76.3 | 2.50 | 4.11 | 34.01 | 5.51 | 131.1 | 7.85 | 1.88 |
| 3 | 199 | 124.4 | 1.64 | 73.5 | 2.62 | 4.17 | 32.07 | 5.51 | 124.6 | 5.55 | 1.65 |
| 4 | 199 | 126.7 | 1.60 | 65.7 | 2.31 | 4.01 | 35.65 | 5.44 | 132.8 | | |
| 5 | 199 | 126.9 | 1.60 | 68.1 | 2.49 | 3.95 | 31.27 | 5.19 | 116.4 | | |
| 6 | 177 | 120.3 | 1.50 | 71.4 | 2.51 | 4.16 | 39.28 | 5.79 | 148.1 | | |
| 7 | 159 | 116.2 | 1.40 | 64.4 | 2.19 | 3.35 | 37.45 | 4.60 | 111.6 | | |
| 8 | 239 | 152.7 | 1.60 | 68.0 | 2.07 | 3.69 | 36.90 | 5.05 | 151.6 | 5.65 | 2.19 |
| 9 | 239 | 151.2 | 1.62 | 66.7 | 2.18 | 3.72 | 34.20 | 4.99 | 140.7 | 5.85 | 2.21 |
| 10 | 239 | 149.5 | 1.64 | 70.5 | 2.24 | 3.82 | 33.50 | 5.10 | 141.2 | 5.60 | 2.30 |
| 11 | 239 | 152.4 | 1.60 | 61.9 | 1.98 | 3.59 | 37.56 | 4.94 | 149.8 | | |
| 12 | 239 | 152.6 | 1.60 | 60.1 | 2.01 | 3.70 | 38.90 | 5.14 | 159.2 | | |
| 13 | 212 | 144.6 | 1.50 | 62.7 | 2.11 | 3.87 | 41.66 | 5.48 | 168.7 | | |
| 14 | 191 | 139.4 | 1.40 | 69.7 | 2.12 | 3.93 | 45.19 | 5.71 | 17.8 | | |
| 15 | 159 | 101.2 | 1.60 | 68.9 | 2.97 | 4.43 | 34.31 | 5.95 | 118.6 | | |
| 16 | 159 | 101.3 | 1.60 | 63.4 | 2.81 | 4.45 | 37.06 | 6.10 | 127.0 | | |
| 17 | 159 | 101.2 | 1.60 | 80.1 | 3.05 | 4.33 | 30.20 | 5.64 | 102.0 | | |
| 18 | 142 | 96.0 | 1.50 | 76.9 | 2.91 | 4.24 | 36.00 | 5.77 | 114.2 | | |
| 19 | 127 | 92.6 | 1.40 | 84.6 | 2.78 | 3.84 | 34.87 | 5.18 | 98.3 | | |
| 20 | 180 | 114.6 | 1.60 | 80.0 | 2.69 | 4.19 | 33.14 | 5.58 | 120.4 | 5.80 | 1.71 |
| 21 | 180 | 113.5 | 1.62 | 76.9 | 2.78 | 4.23 | 32.40 | 5.60 | 118.3 | 4.30 | 1.53 |
| 22 | 180 | 112.2 | 1.64 | 77.5 | 2.93 | 4.33 | 31.50 | 5.69 | 117.0 | 5.70 | 1.54 |

TABLE VII

| Item No. | Spun Den. | # fils | DPF | Spin Speed (mpm) | D.S. (%) | Ten. (g/d) | Eb (%) | Tb (g/d) | T7 (g/d) | T20 (g/d) | S1 (%) | Sm (%) | 1-S1/Sm |
|---|---|---|---|---|---|---|---|---|---|---|---|---|---|
| 1 | 172.0 | 200 | 0.86 | 2195 | 1.86 | 2.51 | 143.4 | 6.11 | 0.64 | 0.59 | 49.9 | 62.6 | 0.20 |
| 2 | 172.0 | 50 | 3.44 | 2195 | 1.64 | 2.10 | 186.7 | 5.02 | 0.57 | 0.52 | 56.4 | 55.9 | −0.01 |
| 3 | 153.0 | 200 | 0.77 | 2469 | 1.74 | 2.81 | 128.2 | 6.41 | 0.68 | 0.64 | 32.7 | 64.9 | 0.50 |
| 4 | 153.0 | 50 | 3.06 | 2469 | 1.80 | 2.51 | 166.8 | 6.70 | 0.59 | 0.56 | 56.3 | 58.9 | 0.04 |
| 5 | 143.0 | 200 | 0.72 | 2195 | 1.70 | 2.52 | 121.0 | 5.57 | 0.64 | 0.62 | 43.3 | 66.0 | 0.34 |
| 6 | 143.0 | 50 | 2.86 | 2195 | 1.43 | 2.18 | 169.2 | 5.87 | 0.57 | 0.54 | 55.1 | 58.6 | 0.06 |
| 7 | 138.0 | 200 | 0.69 | 2743 | 1.61 | 2.67 | 114.0 | 5.71 | 0.75 | 0.80 | 14.4 | 67.1 | 0.79 |
| 8 | 138.0 | 50 | 2.76 | 2743 | 1.58 | 2.52 | 142.4 | 6.11 | 0.63 | 0.59 | 50.2 | 62.7 | 0.20 |
| 9 | 127.0 | 200 | 0.64 | 2469 | 2.06 | 2.86 | 121.1 | 6.32 | 0.72 | 0.74 | 22.6 | 66.0 | 0.66 |
| 10 | 127.0 | 50 | 2.54 | 2469 | 1.34 | 2.59 | 153.6 | 6.57 | 0.63 | 0.59 | 51.1 | 61.0 | 0.16 |
| 11 | 115.0 | 200 | 0.58 | 2195 | 2.24 | 2.72 | 121.9 | 6.04 | 0.71 | 0.69 | 31.8 | 65.9 | 0.52 |
| 12 | 115.0 | 50 | 2.30 | 2195 | 1.34 | 2.49 | 162.9 | 6.54 | 0.60 | 0.57 | 56.1 | 59.6 | 0.06 |
| 13 | 114.0 | 200 | 0.57 | 2743 | 1.35 | 2.86 | 107.9 | 5.95 | 0.83 | 0.93 | 7.8 | 68.0 | 0.89 |
| 14 | 114.0 | 50 | 2.28 | 2743 | 1.50 | 2.78 | 140.4 | 6.68 | 0.63 | 0.59 | 39.4 | 63.0 | 0.37 |
| 15 | 102.0 | 200 | 0.51 | 2469 | 1.55 | 2.57 | 103.3 | 5.22 | 0.80 | 0.86 | 12.5 | 68.7 | 0.82 |
| 16 | 102.0 | 50 | 2.04 | 2469 | 1.24 | 2.35 | 133.3 | 5.19 | 0.64 | 0.59 | 44.9 | 64.1 | 0.30 |

TABLE VII-continued

| Item No. | Spun Den. | # fils | DPF | Spin Speed (mpm) | D.S. (%) | Ten. (g/d) | Eb (%) | Tb (g/d) | T7 (g/d) | T20 (g/d) | S1 (%) | Sm (%) | 1-S1/Sm |
|---|---|---|---|---|---|---|---|---|---|---|---|---|---|
| 17 | 91.7 | 200 | 0.46 | 2743 | 1.79 | 2.76 | 104.9 | 5.66 | 0.95 | 1.10 | 5.2 | 68.5 | 0.92 |
| 18 | 91.7 | 50 | 1.83 | 2743 | 1.18 | 2.85 | 135.2 | 6.70 | 0.69 | 0.65 | 21.0 | 63.8 | 0.67 |

TABLE VIII

| Item No. | Feed Den. | # fils | Drawn Den. | Draw Ratio | Mod. (g/d) | T7 (g/d) | Ten. (g/d) | Eb (%) | Tb (g/d) | WTB (g/d) |
|---|---|---|---|---|---|---|---|---|---|---|
| 1 | 172.0 | 200 | 108.1 | 1.6 | 85.1 | 2.73 | 4.40 | 34.51 | 5.92 | 127.19 |
| 2 | 172.0 | 50 | 108.1 | 1.6 | 59.7 | 1.31 | 2.60 | 42.50 | 3.71 | 84.71 |
| 3 | 153.0 | 200 | 102.5 | 1.5 | 88.4 | 2.77 | 4.24 | 34.55 | 5.70 | 114.85 |
| 4 | 153.0 | 50 | 102.8 | 1.5 | | 1.49 | 3.53 | 55.81 | 5.50 | 137.94 |
| 5 | 143.0 | 200 | 89.8 | 1.6 | 88.2 | 3.19 | 4.59 | 28.03 | 5.88 | 87.72 |
| 6 | 143.0 | 50 | 89.8 | 1.6 | 57.8 | 1.60 | 3.39 | 45.62 | 4.94 | 96.28 |
| 7 | 138.0 | 200 | 98.9 | 1.4 | 81.0 | 2.58 | 4.10 | 40.41 | 5.76 | 124.20 |
| 8 | 138.0 | 50 | 99.2 | 1.4 | 62.6 | 1.51 | 3.68 | 57.60 | 5.80 | 141.16 |
| 9 | 127.0 | 200 | 85.3 | 1.5 | 91.8 | 3.08 | 4.20 | 27.42 | 5.35 | 76.82 |
| 10 | 127.0 | 50 | 85.5 | 1.5 | 66.3 | 1.76 | 3.95 | 52.36 | 6.02 | 122.16 |
| 11 | 115.0 | 200 | 72.1 | 1.6 | 101.4 | 3.66 | 4.62 | 23.81 | 5.72 | 62.56 |
| 12 | 115.0 | 50 | 72.0 | 1.6 | 67.8 | 2.04 | 3.99 | 41.66 | 5.65 | 84.70 |
| 13 | 114.0 | 200 | 82.3 | 1.4 | 91.1 | 2.90 | 4.01 | 33.79 | 5.36 | 88.53 |
| 14 | 114.0 | 50 | 82.5 | 1.4 | 69.0 | 1.74 | 3.84 | 53.20 | 5.88 | 116.02 |
| 15 | 102.0 | 200 | 68.5 | 1.5 | 96.4 | 3.48 | 4.36 | 27.35 | 5.55 | 66.90 |
| 16 | 102.0 | 50 | 68.5 | 1.5 | 73.1 | 2.12 | 3.93 | 41.03 | 5.54 | 79.32 |
| 17 | 91.7 | 200 | 66.1 | 1.4 | 97.0 | 3.26 | 3.95 | 26.09 | 4.98 | 56.35 |
| 18 | 91.7 | 50 | 66.1 | 1.4 | 75.2 | 2.02 | 3.81 | 44.87 | 5.52 | 81.40 |

TABLE IX

| Item No. | Feed Den. | # fils | Draw Ratio | Draw (°C.) | S1 (%) | D.S. (%) | % U |
|---|---|---|---|---|---|---|---|
| 1 | 172 | 200 | 1.64 | 25 | 48.1 | 1.92 | 0.49 |
| 2 | 172 | 50 | 1.64 | 25 | 60.8 | 16.58 | 4.89 |
| 3 | 172 | 200 | 1.64 | 100 | 18.2 | 3.95 | 0.90 |
| 4 | 172 | 50 | 1.64 | 100 | 46.8 | 12.41 | 5.04 |
| 5 | 172 | 200 | 1.64 | 110 | 11.7 | 1.72 | 0.49 |
| 6 | 172 | 50 | 1.64 | 110 | 32.5 | 11.47 | 3.01 |
| 7 | 172 | 200 | 1.64 | 115 | 10.3 | | |
| 8 | 172 | 50 | 1.64 | 115 | 20.5 | | |
| 9 | 172 | 200 | 1.64 | 120 | 9.8 | 3.48 | 0.74 |
| 10 | 172 | 50 | 1.64 | 120 | 18.1 | 7.68 | 1.84 |
| 11 | 172 | 200 | 1.64 | 130 | 8.3 | 2.86 | 0.76 |
| 12 | 172 | 50 | 1.64 | 130 | 10.3 | 5.03 | 1.38 |
| 13 | 172 | 200 | 1.64 | 140 | 7.4 | 2.78 | 0.70 |
| 14 | 172 | 50 | 1.64 | 140 | 8.5 | 4.02 | 1.11 |
| 15 | 172 | 200 | 1.64 | 150 | 6.6 | 2.99 | 0.77 |
| 16 | 172 | 50 | 1.64 | 150 | 7.4 | 3.48 | 0.96 |
| 17 | 172 | 200 | 1.64 | 160 | 6.2 | 2.90 | 0.75 |
| 18 | 172 | 50 | 1.64 | 160 | 6.7 | 3.64 | 1.04 |
| 19 | 172 | 200 | 1.64 | 170 | 5.6 | 2.47 | 0.73 |
| 20 | 172 | 50 | 1.64 | 170 | 6.5 | 3.31 | 1.06 |
| 21 | 172 | 200 | 1.64 | 180 | 5.4 | 5.29 | 1.28 |
| 22 | 172 | 50 | 1.64 | 180 | 6.1 | 3.37 | 1.08 |

TABLE X

| Item No. | Feed Den. | DPF Low | DPF High | Draw Ratio | Draw Temp (°C.) | Set Temp (°C.) | S1 (%) | D.S. (%) | % U |
|---|---|---|---|---|---|---|---|---|---|
| 1 | 199 | 0.78 | 2.58 | 1.64 | 25 | 25 | 47.2 | 2.89 | 0.55 |
| 2 | 199 | 0.78 | 2.58 | 1.64 | 100 | 25 | 22.1 | 2.67 | 0.77 |
| 3 | 199 | 0.78 | 2.58 | 1.64 | 110 | 25 | 14.2 | 2.77 | 0.73 |
| 4 | 199 | 0.78 | 2.58 | 1.64 | 115 | 25 | 10.0 | 2.07 | 0.60 |
| 5 | 199 | 0.78 | 2.58 | 1.64 | 120 | 25 | 10.8 | 2.07 | 0.60 |
| 6 | 199 | 0.78 | 2.58 | 1.64 | 130 | 25 | 9.0 | 1.59 | 0.60 |
| 7 | 199 | 0.78 | 2.58 | 1.64 | 140 | 25 | 7.9 | 2.03 | 0.75 |
| 8 | 199 | 0.78 | 2.58 | 1.64 | 150 | 25 | 7.3 | 2.49 | 0.85 |
| 9 | 199 | 0.78 | 2.58 | 1.64 | 160 | 25 | 6.6 | 2.15 | 0.85 |
| 10 | 199 | 0.78 | 2.58 | 1.64 | 170 | 25 | 6.2 | 2.50 | 0.88 |
| 11 | 199 | 0.78 | 2.58 | 1.64 | 180 | 25 | 5.8 | 2.44 | 0.92 |
| 12 | 127 | 0.50 | 1.65 | 1.40 | 25 | 25 | 28.4 | 1.58 | 0.48 |
| 13 | 127 | 0.50 | 1.65 | 1.40 | 180 | 180 | 5.9 | 1.82 | 0.54 |

TABLE XI

| Item No. | Feed Den. | Draw Ratio | Draw Temp (°C.) | Over Feed (%) | Set Temp (°C.) | Drawn Den | Mod (g/d) | T7 (g/d) | T20 (g/d) | Ten. (g/d) | Eb (%) | Tb (g/d) | S1 (%) |
|---|---|---|---|---|---|---|---|---|---|---|---|---|---|
| 1 | 127 | 1.4 | 25 | 16 | 25 | 104.5 | 23.9 | 1.05 | 1.95 | 2.57 | 37.5 | 3.53 | 21.2 |
| 2 | 127 | 1.4 | 25 | 16 | 180 | 110.8 | 46.3 | 0.97 | 1.83 | 2.26 | 31.0 | 2.96 | 1.4 |
| 3 | 127 | 1.4 | 115 | 16 | 25 | 103.8 | 20.0 | 1.19 | 2.19 | 2.64 | 32.6 | 3.50 | 7.8 |

TABLE XI-continued

| Item No. | Feed Den. | Draw Ratio | Draw Temp (°C.) | Over Feed (%) | Set Temp (°C.) | Drawn Den | Mod (g/d) | T7 (g/d) | T20 (g/d) | Ten. (g/d) | Eb (%) | Tb (g/d) | S1 (%) |
|---|---|---|---|---|---|---|---|---|---|---|---|---|---|
| 4 | 127 | 1.4 | 115 | 16 | 180 | 108.2 | 36.2 | 1.10 | 2.07 | 2.58 | 33.5 | 3.44 | 1.6 |
| 5 | 127 | 1.4 | 180 | 16 | 25 | 103.8 | 18.9 | 1.27 | 2.44 | 2.54 | 22.3 | 3.11 | 3.8 |
| 6 | 127 | 1.4 | 180 | 16 | 180 | 104.2 | 37.7 | 1.42 | 2.43 | 2.74 | 27.5 | 3.49 | 1.9 |
| 7 | 159 | 1.6 | 25 | 16 | 25 | 116.3 | 28.0 | 1.06 | 1.84 | 2.66 | 37.2 | 3.65 | 40.3 |
| 8 | 159 | 1.6 | 25 | 16 | 180 | 138.1 | 34.3 | 0.76 | 1.23 | 2.37 | 49.6 | 3.55 | 1.7 |
| 9 | 159 | 1.6 | 115 | 16 | 25 | 114.4 | 21.1 | 1.27 | 2.37 | 2.66 | 26.0 | 3.35 | 8.7 |
| 10 | 159 | 1.6 | 115 | 16 | 180 | 120.6 | 29.8 | 0.94 | 2.07 | 2.76 | 34.0 | 3.70 | 1.9 |
| 11 | 159 | 1.6 | 180 | 16 | 25 | 114.4 | 18.4 | 1.23 | 2.63 | 2.91 | 24.8 | 3.63 | 4.4 |
| 12 | 159 | 1.6 | 180 | 16 | 180 | 115.1 | 24.7 | 1.24 | 2.58 | 2.85 | 24.7 | 3.55 | 2.6 |

We claim:

1. A mixed-filament polyester yarn comprised of fine filaments and fatter filaments that differ in denier but are of the same polyester polymer, wherein said fine filaments are of filament denier 0.2 to 1, said fatter filaments are of higher filament denier more than 1, and wherein the ratio of the average filament denier of said fatter filaments to the average filament denier of said fine filaments is in the range 2:1 to 6:1, wherein the polyester polymer is of relative viscosity (LRV) in the range of 13 to 23, of zero-shear melting point ($T_M^o$) in the range of 240° C. to 265° C., and of glass-transition temperature ($T_g$) in the range of 40° C. to 80° C., and wherein the yarn has an elongation-to-break ($E_B$) of 40% to 160%, a tenacity-at-7% elongation ($T_7$) in the range of 0.5 to 1.75 g/d, and shrinkage values such that the thermal stability value ($S_2$=DHS−S) is +2% or less, and the ($1-S/S_m$) value is at least 0.1, where S is the boil-off shrinkage, $S_m$ is the maximum shrinkage potential and DHS is the dry heat shrinkage measured at 180° C., and the maximum dry heat Shrinkage Tension ($ST_{max}$) is 0.2 g/d or less at a peak temperature T($ST_{max}$) that is in a range of 5 to 30 degrees above the glass-transition temperature ($T_g$).

2. A yarn according to claim 1, having an elongation-to-break ($E_B$) of 90% to 120%, a tenacity-at-7% elongation ($T_7$) in the range of 0.5 to 1 g/d, and a ($1-S/S_m$) value of at least 0.25, whereby said yarn is especially suitable as a draw feed yarn.

3. A yarn according to claim 1, having an elongation-to-break ($E_B$) of 40% to 90%, a tenacity-at-7% elongation ($T_7$) in the range of 1 to 1.75 g/d, and a ($1-S/S_m$) value of at least 0.85, whereby said yarn is especially suitable for a direct use yarn.

4. A yarn according to claim 3 that is a mixed shrinkage yarn, wherein some filaments have a low shrinkage (S) such that the ($1-S/S_m$) value is at least 0.85 and other filaments have a high shrinkage (S) such that the ($1-S/S_m$) value is in the range of 0.25 to 0.85, and wherein the difference in filament shrinkages (S) is in the range of 5% to 50%, where S is boil-off shrinkage and $S_m$ is the maximum shrinkage potential.

5. A yarn according to claim 4 that is bulky.

6. A yarn according to claim 3 that is bulky.

7. A mixed-filament polyester yarn comprised of fine filaments and fatter filaments that differ in denier but are of the same polyester polymer, wherein said fine filaments are of filament denier 0.2 to 1, said fatter filaments are of higher filament denier more than 1, and wherein the ratio of the average filament denier of said fatter filaments to the average filament denier of said fine filaments is in the range 2:1 to 6:1, wherein the polyester polymer is of relative viscosity (LRV) in the range of 13 to 23, of zero-shear melting point ($T_M^o$) in the range of 240° C. to 265° C., and of glass-transition temperature ($T_g$) in the range of 40° C. to 80° C. wherein the yarn has an elongation-to-break ($E_B$) of 15% to 45%, a tenacity-at-7% elongation ($T_7$) of 1–4 g/d, a post yield modulus ($M_{py}$) in the range of 5 to 25 g/d, and a ($1-S/S_m$) of at least 0.85, where S is the boil off shrinkage and $S_m$ is the maximum shrinkage potential.

8. A yarn according to claim 7 that is bulky.

9. A yarn according to any one of claims 1 to 8, wherein the product of the average denier of the filaments and of is 1 or less.

10. A yarn according to any one of claims 1 to 9 having an along-end uniformity as measured by an along-end denier spread (DS) of less than 3%.

* * * * *